US005740731A

United States Patent [19]

Kagawa

[11] Patent Number: 5,740,731

[45] Date of Patent: Apr. 21, 1998

[54] IMAGE WRITING DEVICE FOR A STENCIL PRINTER

[75] Inventor: Hideyuki Kagawa, Sendai, Japan

[73] Assignee: Tohoku Ricoh Co., Ltd., Miyagi-ken, Japan

[21] Appl. No.: 713,971

[22] Filed: Sep. 12, 1996

[30] Foreign Application Priority Data

Dec. 22, 1995 [JP] Japan ..... 7-335131
Jul. 29, 1996 [JP] Japan ..... 8-199179

[51] Int. Cl.[6] ..... B41L 13/04

[52] U.S. Cl. ..... 101/128.4; 206/409

[58] Field of Search ..... 101/114, 116, 101/119, 120, 121, 122, 125, 128, 128.1, 128.21, 128.4, 129; 206/409; 242/171, 348.2, 348.3, 419.4

[56] References Cited

U.S. PATENT DOCUMENTS

| | | | |
|---|---|---|---|
| 3,788,221 | 1/1974 | Borneman | 101/116 |
| 4,628,813 | 12/1986 | Hasegawa et al. | 101/116 |
| 4,966,073 | 10/1990 | Hasegawa et al. | 101/120 |
| 5,048,416 | 9/1991 | Iijima | 101/115 |
| 5,253,581 | 10/1993 | Miki et al. | 101/121 |
| 5,640,904 | 6/1997 | Sato et al. | 101/128.4 |

FOREIGN PATENT DOCUMENTS

| | | | |
|---|---|---|---|
| 021577 | 1/1987 | Japan | 101/128.4 |
| 151454 | 6/1988 | Japan | 101/128.4 |
| 63-178134 | 11/1988 | Japan . | |
| 6-32041 | 2/1994 | Japan . | |
| 6-227110 | 8/1994 | Japan . | |
| 6-239047 | 8/1994 | Japan . | |
| 7-17013 | 1/1995 | Japan . | |
| 7-101135 | 4/1995 | Japan . | |
| 7-125400 | 5/1995 | Japan . | |

*Primary Examiner*—Ren Yan

*Attorney, Agent, or Firm*—Oblon, Spivak, McClelland, Maier & Neustadt, P.C.

[57] ABSTRACT

In a stencil printer, a device for writing an image in a stencil has a master holding unit movable between an operative position and an inoperative position while being guided by guiding means. In the inoperative position, the stencil holding unit allows the operator to pull out the leading edge of a stencil from a roll, lay it on stencil guiding means included in the unit, cause stencil conveying means, also included in the unit, and the stencil guiding means to nip the leading edge of the stencil, and then move the unit toward the operative position. Only if the operator performs such a simple operation, stencil drive means drives the stencil conveying means and causes it to convey the leading edge of the stencil. This insures the easy understanding of the roll replacement procedure and allows the roll to be loaded and unloaded and the stencil to be set with ease.

36 Claims, 30 Drawing Sheets

IMAGE WRITING DEVICE FOR A STENCIL PRINTER

BACKGROUND OF THE INVENTION

The present invention relates to a master making device for a stencil printer and, more particularly, to a device for writing an image in a stencil by cutting it with heat. A stencil printer of the type using a thermosensitive digital master making system is a simple and convenient printer extensively used today. For this type of printer, use is made of a stencil having a thermoplastic resin film. A thermal head cuts the stencil with heat in accordance with image data. After the cut stencil or master has been wrapped around a drum, ink is caused to ooze out to the outer periphery of the drum. When a sheet is pressed against the periphery of the drum, the ink is transferred from the drum to the sheet via the perforations of the master. The thermal head has a plurality of heating elements arranged in the main scanning direction parallel to the axial direction of the drum. The heating elements are selectively caused to generate heat and thereby cut the stencil by melting it.

Conventional stencil printers include one having a document reading section disposed above an image writing section, as taught in, e.g., Japanese Utility Model Laid-Open Publication No 63-178134. With this kind of printer, it is possible to effect a document reading operation and a master making operation in a continuous procedure. Usually, a stencil is implemented as a roll having a tubular core at its center for the purpose of reducing the area which it occupies. It has been customary with such a printer to replace a used roll with a new roll by the following sequence of steps.

First, the operator moves the document reading section away from its regular or operative position, so that the operator can see the entire writing section from the above. Then, the operator operates a roller release lever for releasing the thermal head from a platen roller. As a result, the pressure acting on the leading edge of the stencil between the head and the platen roller is cancelled. In this condition, the operator picks up the used roll from the the roll support portion of the writing section together with flanges attached to the opposite ends of the tubular core of the roll. Subsequently, the operator removes the flanges from the used roll, attaches them to the opposite ends of the tubular core of the new roll, and then puts the new roll in the roll support portion. Thereafter, the operator pulls out the leading edge of the stencil from the new roll by hand, inserts it into the gap between the head and the platen roller, and then returns the roller release lever to its original position. Consequently, the leading edge of the stencil is pressed by the head and roller.

The operator is often expected to rotate the flanges of the new roll in the direction opposite to the stencil feed direction in order to straighten the stencil between the head and platen roller and the roll. Subsequently, the operator presses a stencil cut-off button to cut off the leading edge portion of the stencil at a preselected length or in a preselected configuration, takes out the cut piece of the stencil, and then returns the document reading section to its operative position.

Various kinds of schemes using relatively thin stencils or using stencils each consisting substantially only of a thermoplastic resin film have been proposed in order to miniaturize the printer, to reduce the diameter of the roll, to reduce fiber marks which lower image quality, and to reduce the cutting or perforating time for implementing high-speed master making. It is to be noted that the stencil consisting only of a thermoplastic resin film refers also to a thermoplastic resin film containing a trace of, e.g., antistatic agent or a thermoplastic resin film having one or more overcoat layers or similar thin layers on at least one of opposite major surfaces thereof. The stencil is in many cases relatively thin and formed of thermoplastic resin. Therefore, when the stencil is implemented as a roll, the leading edge of the stencil is apt to break or bend when paid out from the roll. Moreover, a shaft is sometimes positioned at the center of the roll and driven to pay out the stencil from the roll. In this case, if the roll is new, a torque great enough to cope with the greatest outside diameter of the roll is needed. Such a torque increases the size of a drive mechanism and sometimes cannot be surely transferred to the roll.

In light of the above, a master making device facilitating the loading of a stencil roll and allowing a stencil to be paid out from the roll surely and automatically is taught in, e.g., pending U.S. patent application Ser. No. 08/690,547, filed on Jul. 31, 1996.

The master making device disclosed in previously mentioned Laid-Open Publication No. 63-178134 has the following problems left unsolved. The operation for replacing the roll is sophisticated, difficult to understand, and troublesome. Specifically, the operator must move the document reading section, remove the flanges from the used roll, attach them to the new roll, insert the leading edge of the stencil into the gap between the thermal head and the platen roller, cut off the leading edge of the stencil, and take out the cut piece of stencil. This cannot be done without resorting to expert knowledge.

On the other hand, the master making device taught in pending U.S. patent application Ser. No. 08/690,547, filed on Jul. 31, 1996 is capable of peeling and separating the leading edge of the stencil from the roll automatically despite that the stencil lacks in elasticity. However, even this device is apt to fail to peel and separate the leading edge of the stencil from the roll due to irregularity in the outside diameter of the roll or on account of temperature, humidity and other ambient conditions which are subtly linked together. The device is therefore not sufficiently reliable. Moreover, the automatic peeling and separation of the stencil from the roll is not practicable without resorting to a complicated and expensive arrangement.

SUMMARY OF THE INVENTION

It is therefore an object of the present invention to provide an image writing device for a stencil printer and allowing the operator to replace a stencil roll by a simple and easy operation, and facilitating the loading and unloading of the roll as well as the setting of a stencil.

It is another object of the present invention to provide an image writing device for a stencil printer and capable of surely paying out the leading edge of a stencil from a stencil roll, highly reliable, and promoting the simple and inexpensive configuration of the printer.

It is a further object of the present invention to provide an image writing device for a stencil printer and using a relatively thin stencil in order to miniaturize the printer, to reduce the diameter of the roll, to reduce fiber marks which lower image quality, and to reduce the cutting or perforating time for implementing high-speed master making.

In accordance with the present invention, a device for writing an image in a stencil has a body. A stencil storing section stores the stencil in the form of a roll such that the stencil can be paid out from the roll. A master making section cuts the stencil paid out from the roll to thereby make a master. A cutting section cuts off the master from the stencil. A stencil holding unit is movable between an operative position defined in the body, and an inoperative position remote from the operative position and allowing the roll to be loaded and unloaded from the stencil storing section. A guide member guides the stencil holding unit between the operative position and the inoperative position. A stencil guide member is included in the stencil holding unit and allows the leading edge of the stencil paid out from the roll to be laid thereon. A stencil conveying member is included in the stencil holding unit and conveys the stencil in contact with the stencil guide member via the leading edge of the stencil. A stencil drive source drives the stencil conveying member.

Also, in accordance with the present invention, a device for writing an image in a stencil for a stencil printer has a stencil storing section which stores the stencil in the form of a roll such that the stencil can be paid out from the roll. A master making section cuts the stencil paid out from the roll to thereby produce a master. A cutting section cuts off the master from the stencil. A stencil holding section is capable of being loaded with the roll. A stencil guide member adjoins the stencil holding section and allows the leading edge of the stencil paid out from the roll to be laid thereon. A stencil conveying member adjoins the stencil holding section and conveys the stencil in contact with the stencil guide member via the leading edge of the stencil. A stencil drive source drives the stencil conveying member. The master making section, stencil holding section, stencil guide member and stencil conveying member constitute a master making unit movable between an operative position defined within a body of the printer and an inoperative position remote from the operative position and allowing the roll to be loaded and unloaded.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
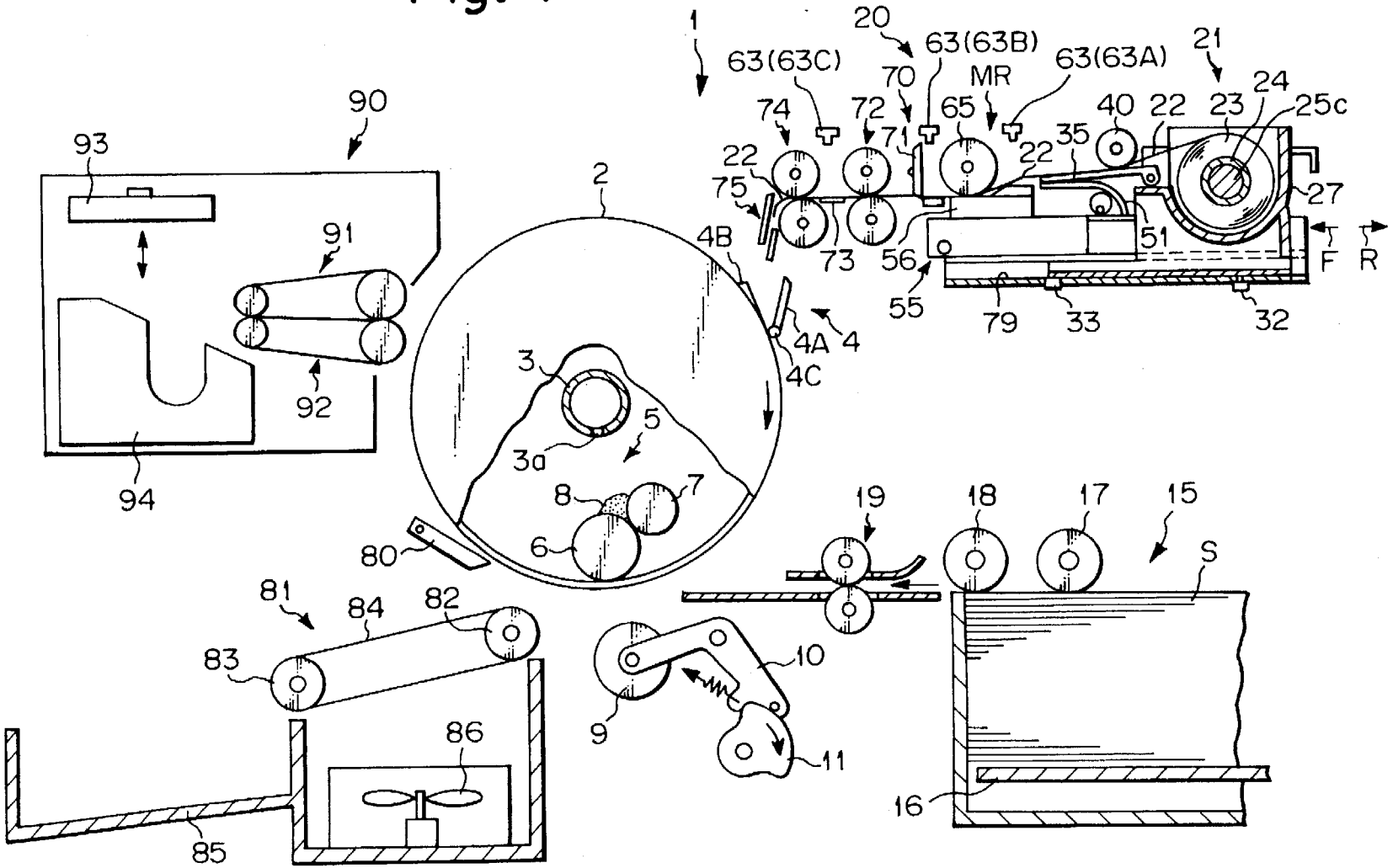
FIG. 1 is a partly sectional front view showing the general construction of a stencil printer to which a first embodiment of the image writing device in accordance with the present invention is applied.

Preferred embodiments of the image writing device in accordance with the present invention will be described hereinafter with reference to the accompanying drawings. In the drawings, various constituent parts are sometimes not shown in order to facilitate an understanding. As for each pair of parts which do not need distinction, only one of them will be described, as the case may be. Regarding the description of the individual part and its position, the terms "front" and "rear" respectively refer to the downstream side and upstream side in a stencil transport direction or stencil pay-out direction. The right-hand side and left-hand side in the widthwise direction of a stencil, as seen in the stencil transport direction, will sometimes be respectively referred to as a "right (rear in the direction perpendicular to the sheet surfaces of the drawings)" and "left (front as seen in the same direction)". In the embodiments and modifications thereof, identical parts and elements are designated by identical reference numerals, and a detailed description thereof will not be made in order to avoid redundancy.

1st Embodiment

Referring to FIG. 1 of the drawings, a stencil printer to which this embodiment is applied is shown. As shown, the printer, generally 1, is generally made up of a sheet feeding device 15, an image writing device or master making device 20, a printing section including a drum 2, a master discharging section 90, and a sheet discharging section.

While the sheet feeding section 15, master discharging section 90 and sheet discharging section each has a conventional construction, the image writing device 20 has a unique configuration.

The drum 2 is reversibly rotatable about a shaft 3. Specifically, the drum 2 is rotated clockwise during printing or counterclockwise during the discharge of a used master. A master formed by the writing device 20, as will be described, is wrapped around the outer periphery of the drum 2 and the drum 2 functions in a conventional manner. The circumferential surface of the drum 2 is formed with a number of pores except a part thereof. A thin mesh screen, not shown, is affixed to the surface of the drum 2 and formed of, e.g., synthetic fibers. The mesh screen may be formed of metal, if desired.

A damper 4 is mounted on the part of the circumferential surface of the drum 2 where the pores are absent. The damper 4 has a stage 4B and a clamp member 4A cooperative to clamp the leading edge of a stencil. The stage 4B extends along one of lines parallel to the axis of the drum 2. The clamp member 4A is mounted on a shaft 4C positioned on one end of the stage 4B and is rotatable about the shaft 4C toward and away from the stage 4B. The stage 4B and clamp member 4A are made of a magnetic material and rubber magnet, respectively. After the leading edge of the master has been positioned on the stage 4B, the clamp member 4A is pressed against the stage 4B with the intermediary of the master. The portion of the master following the leading edge is adhered to the drum 2 by the adhesion of ink fed from an ink supply mechanism 5 toward the surface of the drum 2.

Specifically, the ink supply mechanism 5 is disposed in the drum 2 substantially beneath the shaft 3. The mechanism 5 has an ink roller 6 and a doctor roller 7. The ink roller 6 is formed of metal and located to face a press roller 9 with the intermediary of the drum 2. The ink roller 6 is rotatable at a peripheral speed synchronous to that of the drum 2 in contact with the inner periphery of the drum 2. Ink is fed by the ink roller 6 into the pores of the drum 2 and mesh screen in a preselected amount regulated by the doctor roller 7. The ink is dropped from an outlet **3*a* formed in the shaft 3 into a wedge-shaped ink well 8 formed between the rollers 6 and 7. The ink roller 6 additionally plays the role of a back-up roller for preventing the drum 2 from deforming when the press roller 9 is pressed against the drum 2**.

The ink roller 9 is a rotatable member movable into and out of contact with the drum 2. Specifically, the roller 9 is rotatably mounted on one free end of a rotatable arm 10. The other free end of the arm 10 is pressed against the contour of a sectorial cam 11. A drive source, not shown, rotates the cam 11 in synchronism with the feed of a sheet S from the sheet feeding device 15. When no sheets S are fed from the device 15, the cam 11 contacts the other free end of the arm 10 at its larger diameter portion. When the sheet S is fed from the device 15, the cam 11 is rotated to bring its smaller diameter portion into contact with the other free end of the arm 10. As a result, the arm 10 is rotated clockwise as viewed in FIG. 1. Therefore, when the sheet S reaches the gap between the drum 2 and the press roller 9, the roller 9 is raised and pressed against the drum 2 with the intermediary of the sheet S. As the sheet S is pressed against the drum 2 with the intermediary of the master wrapped around the drum 2, the ink is transferred from the drum 2 to the sheet S via perforations formed in the master, forming an image on the sheet S. In this sense, the position where the press roller 9 faces the drum 2 will be referred to as an image transfer position.

The sheet feeding device 15 is located at the right-hand side of the press roller 9, as viewed in FIG. 1. The device 15 has a pick-up roller 17, a separation roller 18 and a registration roller pair 19 which are sequentially arranged in the sheet feed direction. The pick-up roller 17 is movable relative to and into and out of contact with the uppermost one of the sheets S stacked on a tray 16. The pick-up roller 17 drives the top sheet S in contact therewith in the direction indicated by an arrow in FIG. 1. The tray 16 is elevatable until the top sheet S contacts the pick-up roller 17. When sheets S should be replenished, the tray 16 is lowered to form a space thereabove for the insertion of the sheets S. The separation roller 18, like the pick-up roller 17, is rotatable in contact with the top sheet S so as to feed only the top sheet S. For this purpose, the coefficient of friction between the roller 18 and the top sheet S is selected to be greater than the coefficient of friction between the sheets S. The rollers of the registration roller pair 19 face each other with the intermediary of a sheet transport path. The roller pair 19 drive the sheet S toward the previously mentioned image transfer position at a preselected timing.

More specifically, when the tray 16 is raised until the top sheet S contacts the pick-up roller 17, the roller 17 is rotated in response to a signal output from a sensor, not shown. While the pick-up roller 17 pays out the top sheet S, the separation roller 18 separates the sheet S from the underlying sheets S. As a result, the sheet S is conveyed toward the registration roller pair 19. The roller pair 19 once stops the sheet S and then drives it toward the image transfer position such that the leading edge of the sheet S meets the leading edge of the image area of the master. Thereafter, an image is formed on the sheet S by the previously stated printing operation.

Figure 2:
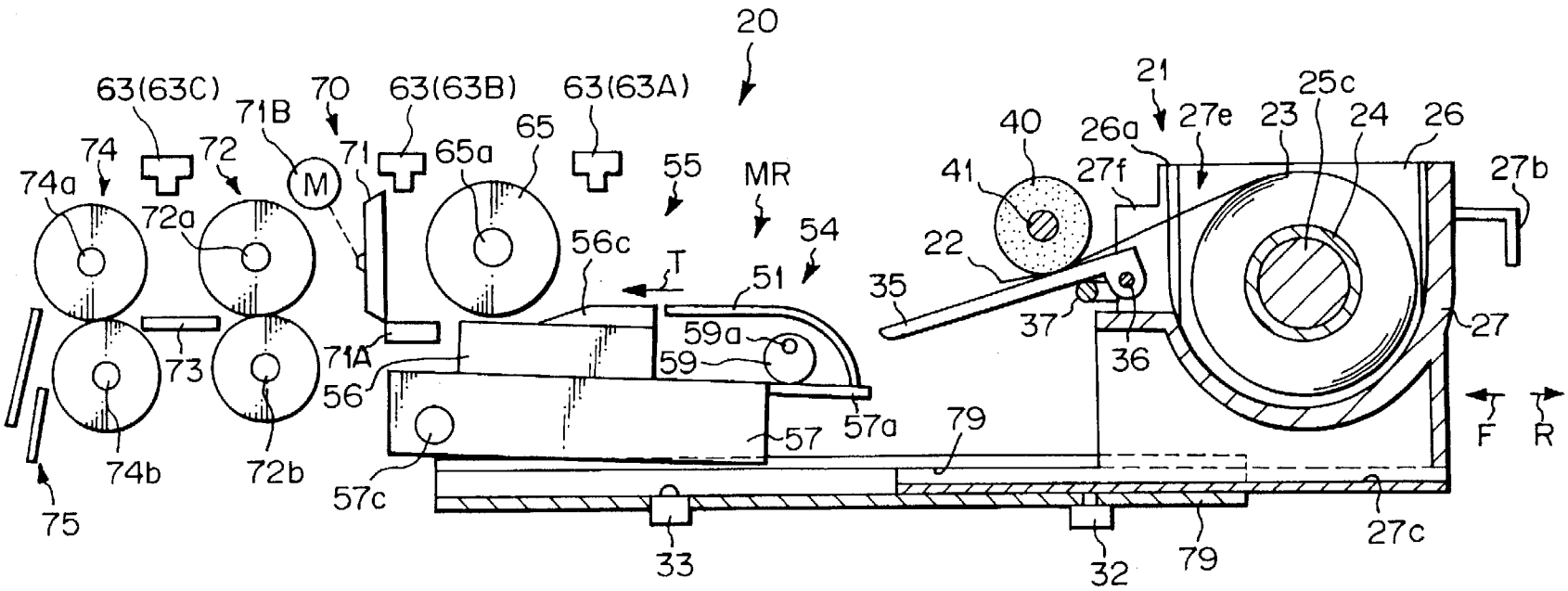
FIG. 2 is a partly sectional enlarged front view showing a stencil holding unit included in the first embodiment and located at its inoperative position.
Figure 3:
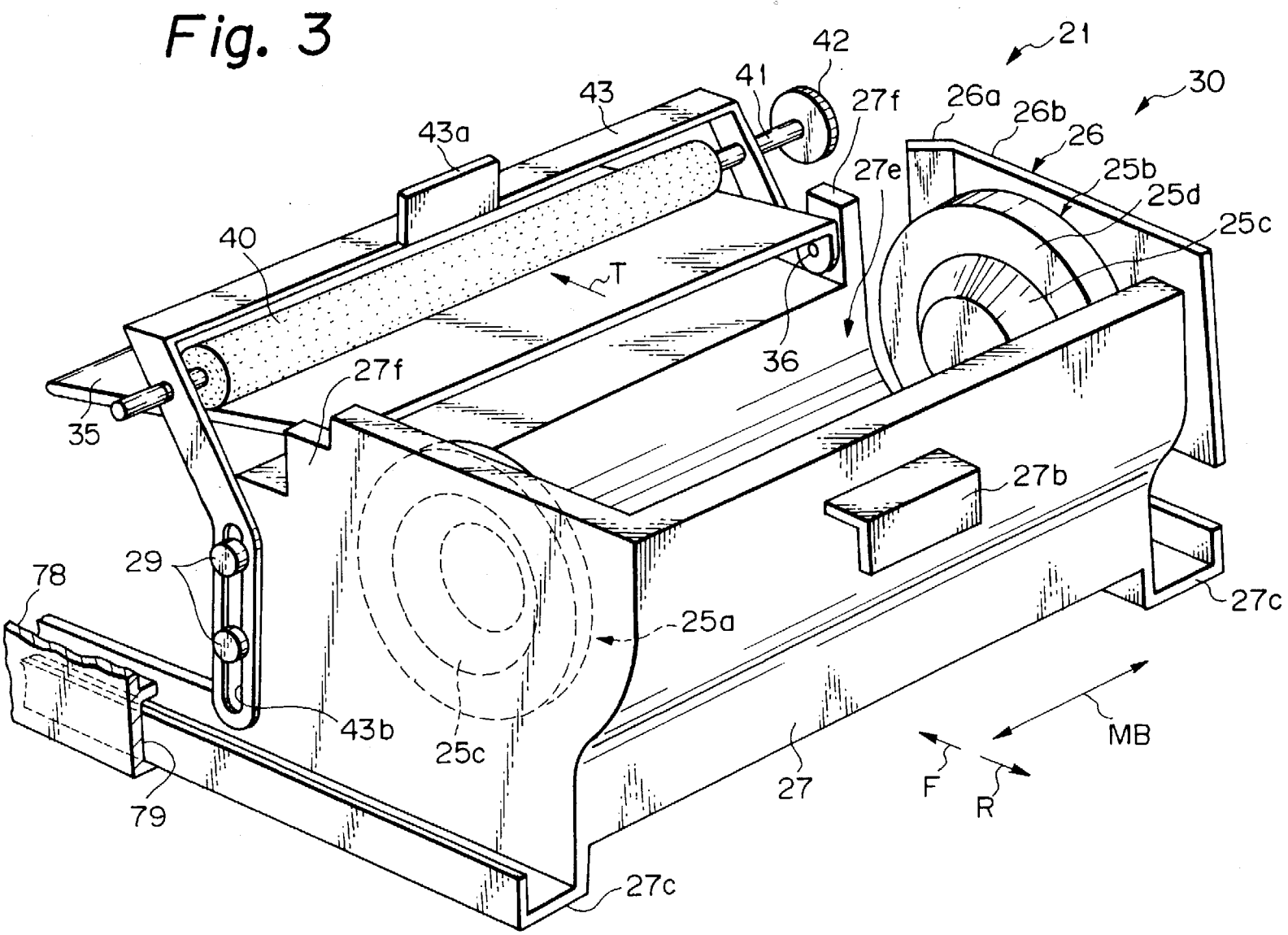
FIG. 3 is a perspective external view of the stencil holding unit.
Figure 4:
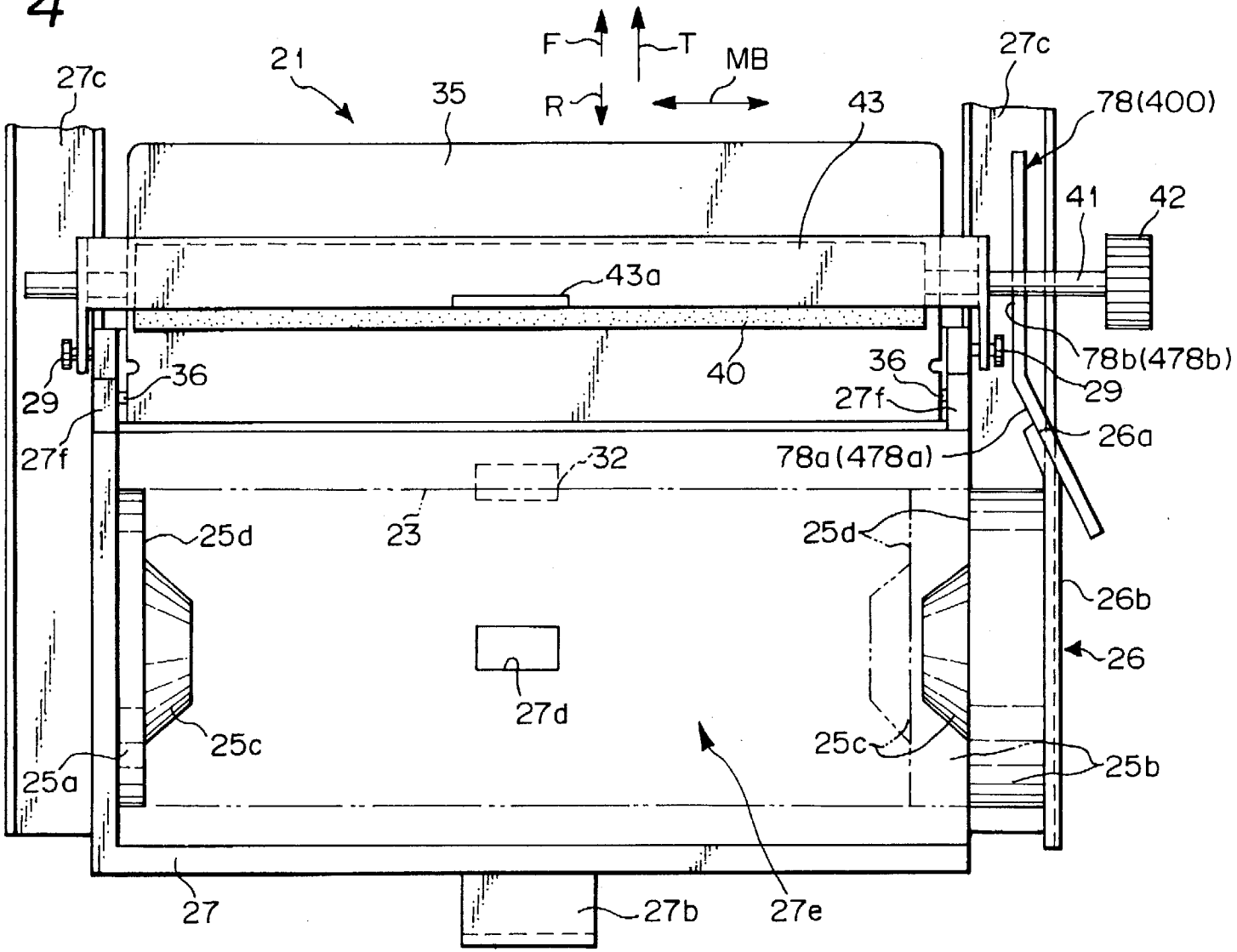
FIG. 4 is a fragmentary plan view of the stencil holding unit.

The image writing device 20 is positioned above and at the right-hand side of the drum 2. As shown in FIGS. 1 and 2, the device 20 has a stencil holding unit 21, a platen pressure control section 55, and a cutting section 70. As shown in FIGS. 3 and 4 in detail, the stencil holding section 21 has a roll holder 27, a right and a left roll flange **25*a* and 25*b*, a guide plate 35, and a pay-out roller 40. A stencil 22 is implemented as a roll 23 and held by the roll flanges or stencil storing means 25*a* and 25*b*. The stencil holding unit 21 is slidable between an operative position shown in FIG. 1 and an inoperative position shown in FIG. 2, as indicated by arrows F and R, while being guided by guiding means which will be described. The unit 21 reaches the operative position when inserted into the body of the device 20. At the inoperative position remote from the operative position, the unit 21 allows the stencil roll 23 to be loaded and unloaded therefrom. The inoperative position includes even the position where the unit 21 is pulled out of the printer 1. Therefore, the operator can move the unit 21 into and out of the device 20 without sliding an image reading unit positioned in the upper portion of the printer 1**. This simplifies the construction and reduces the weight, size and cost of the printer.

Figure 5:
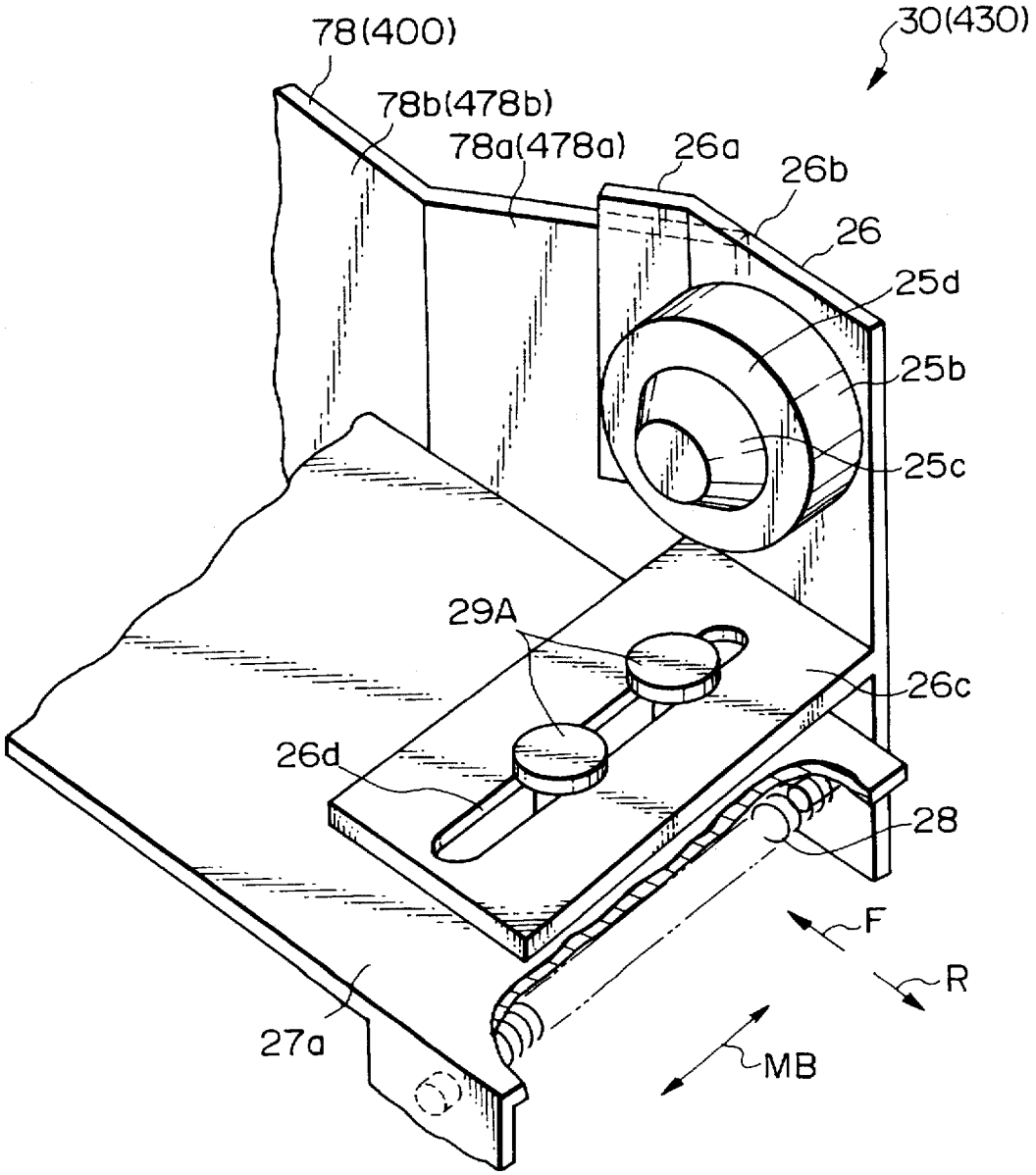
FIG. 5 is a fragmentary external perspective view showing roll positioning means and roll positioning guiding means included in the stencil holding unit.

As shown in FIG. 2, the stencil 22 paid out from the roll 23 is conveyed along a stencil transport path MR. In FIGS. 3 and 5, labeled MB is the widthwise direction of the stencil 22 parallel to the axis of the roll 23.

Figure 8:
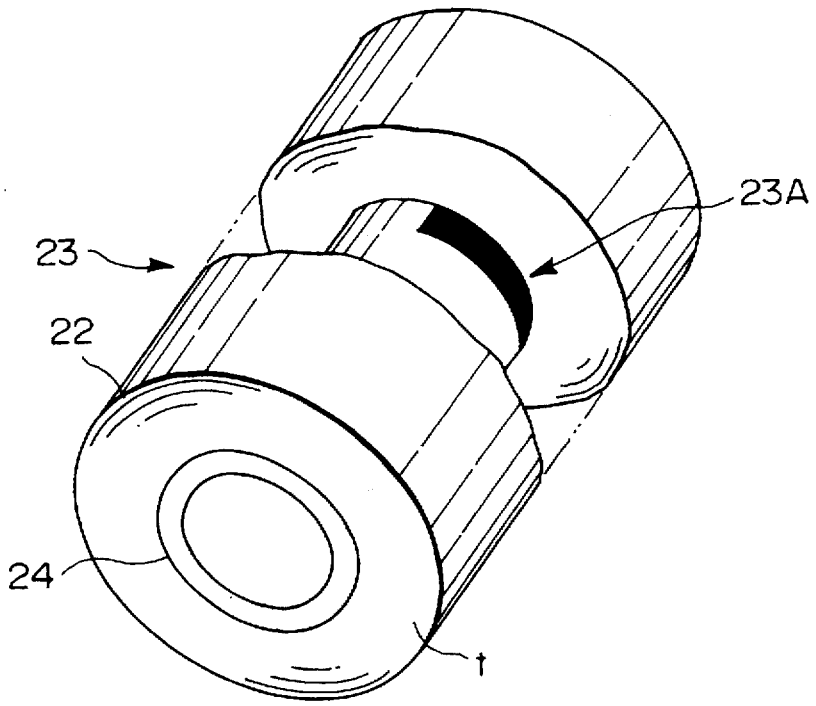
FIG. 8 is a partly cut away perspective view showing a stencil roll applicable to the first embodiment.

As shown in FIG. 8, the stencil 22 is wound round a tubular core 24 having a length equal to the width of the stencil 22, forming the stencil roll 23. The axially opposite ends t of the roll 23 are flush with the axially opposite ends of the core 24. The core 24 is formed of synthetic resin, paper or similar material. The stencil 22 has a laminate structure comprising a thermoplastic resin film transparent to light and as thin as about 1 μm to 2 μm, and a porous substrate formed of Japanese paper fibers or synthetic fibers or a mixture thereof. The thermoplastic resin may be, e.g., polyester.

The stencil 22 has a total thickness about one half of the thickness of a conventional stencil which ranges from 40 μm to 60 μm. In the illustrative embodiment, the stencil 22 is 3 μm to 30 μm thick. This reduces the outside diameter of the roll 23 and thereby reduces the overall dimensions of the device 20. In addition, such a thin stencil 22 reduces fiber marks and thereby enhances image quality, and reduces the stencil cutting time and thereby enhances high-speed master making.

The roll 23 includes a low reflectance portion 23A extending from its preselected limit diameter position which is the end of the usable length to the end in the direction of winding. To form the low reflectance portion 23A, the end portion of the stencil 22 may be painted black at substantially the intermediate between the axially opposite ends of the core 24. Alternatively, the intermediate portion of the core 24 may be painted black. The crux is that the above portion 23A be sensed by stencil sensing means, which will be described, through the stencil 22.

The roll holder 27 is a single box-like molding formed of resin. An opening broad enough to facilitate the loading and unloading of the roll 23 is formed in the top wall of the roll holder 27. A cavity 27*e* for accommodating the roll 23 is formed in the roll holder 27 and has a generally U-shaped cross-section.

As shown only in FIG. 4, a hole 27*d* is formed in substantially the center of the bottom wall of the roll holder 27. The stencil sensing means will face the hole 27*d* when the stencil holding unit 21 is brought to its operative position. A handle 27*b* is formed integrally with the roll holder 27 at the center of the rear wall. The operator holds the handle 27*b* when inserting the unit 21 toward the operative position (FIG. 1) in the direction F or when pulling it out toward the inoperative position (FIG. 2) in the direction R. Top-open channel-like slide rails 27*c* are formed integrally with the bottom portions of opposite side walls of the roll holder 27. Sheet metal is suitably provided on the slide rails 27*c* for reinforcement.

As shown in FIG. 3, the body of the device 20 includes a right and a left side wall 78 implemented by sheet metal. The side walls 78 are each formed with a guide rail 79 at its bottom. The guide rails 79 of the side walls 78 are respectively engaged with the slide rails 27*c* of the roll holder 27, as illustrated. The guide rails 79 play the role of guiding means for guiding the stencil holding unit 21 between the operative position and the inoperative position.

Engaging means, not shown, is provided on the roll holder 27 in the vicinity of the guide rails 27*c*. When the stencil holding unit 21 is brought to the operative position, the engaging means is engaged with locking means, not shown, provided on the side walls 78. The engaging means is connected to the handle 27*b* by a lever link mechanism or similar mechanism, not shown. For example, when the operator holds the handle 27*b*, the engaging means is released from the locking means.

The roll flanges 25*a* and 25*b* are identical in configuration, and each has a frustoconical portion 25*c* and a friction portion 25*d*. The frustoconical portion 25*c* is capable of mating with the adjoining end of the tubular core 24 of the roll 23 while the friction portion 25*d* is capable of contacting the adjoining end of the roll 23. The portion 25*c* has a frustoconical surface while the friction portion 25*d* has an annular surface. The frustoconical portion 25*c* of the roll flange 25*b* is movable into and out of the core 24 via roll positioning guiding means, which will be described, thereby positioning the roll 23 tridimensionally, i.e., in a stencil transport direction T and widthwise direction MB and in the direction of height. The base of each frustoconical portion 25*c* has an outside diameter slightly smaller than the inside diameter of the core 24. The roll flanges 25*a* and 25*b* are formed of, e.g., acrylonitrile butadien styrene (ABS) resin, polycarbonate resin or similar synthetic resin. The friction portions 25*d* exert frictional resistance on the roll 23 when the roll 23 is rotated to pay out the stencil 22. The resistance generates tension (back-tension) in the stencil 22 and thereby prevents the stencil 22 from slackening during pay-out. The friction portions 25*d* may be implemented as rubber sheets adhered to the roll flanges 25*a* and 25*b*, if desired.

As shown in FIG. 3, the left roll flange 25*a* is affixed to the inner periphery of one side wall of the roll holder 27 while the right roll flange 25*b* is affixed to the inner periphery of a flange support plate 26 separate from the roll holder 27. The roll flange 25*b* is movable between an advanced position (dash-and-dots line in FIG. 4) and a retracted position (solid line in FIG. 4). When the stencil holding unit 21 is brought to the operative position, the flange 25*b* is brought to the advanced position for contacting and positioning one end t of the roll 23. When the unit 21 is moved away from the operative position, the flange 25*b* is moved to the retracted position.

In FIGS. 3–5, the previously mentioned roll positioning guiding means is designated by the reference numeral 30. The guiding means 30 guides the roll flange or roll positioning means 25*b* between the above advanced position and the retracted position. As shown, the guiding means 30 has an inclined guide portion 78*a* and a slide guide portion 78*b* included in the side wall 78, an inclined portion 26*a*, slide portion 26*b*, a slide piece 26*c* and a slot 26*d* included in a flange support plate 26, a guide plate 27*a*, two stepped pins 29A studded on the guide plate 27*a*, and a compression spring 28.

Specifically, as shown in FIGS. 4 and 5, the right side wall 78 has its rear end bent outward in order to form the inclined guide portion 78*a*, and has the slide guide portion 78*b* parallel to the left side wall 78. The flange support plate 26 implemented by sheet metal has its front end in the direction F bent inward to form the inclined portion 26*a*, and additionally has the slide portion 26*b* parallel to the slide guide portion 78*b* of the side wall 78, and slide piece 26*c* extending from and perpendicular to the inner periphery of the support plate 26 below the roll flange 25*b*, as shown only in FIG. 5. The slot 26*d* is formed in the slide piece 26*c* in the direction parallel to the widthwise direction MB of the stencil.

As shown only in FIG. 5, the guide plate 27*a* extends upright from the bottom wall of the roll holder 27 and then bent to the right, as viewed in the figure, at right angle. The guide plate 27*a* slidably contacts the rear of the slide piece 26*c* at its bent or horizontal portion. The guide plate 27*a* is implemented by sheet metal. The two stepped pins 29A are studded on the top of the guide plate 27*a* and loosely received in the slot 26*d* of the slide piece 26*c*. The compression spring 28 is loaded between the upright wall of the guide plate 27*a* and the inner periphery of the slide portion 26*b*. The spring 28 constantly biases the flange support plate 26 in the direction in which the roll flange 25*b* moves away from the end t of the roll 23.

Of course, the roll flange 25*a* may also be configured to move between its advanced position and retracted position, in which case another guiding means 30 will be assigned to the flange 25*a*.

As shown in FIG. 3, the roll holder 27 is formed with a pair of guide plate support portions 27*f* at the right and left of its upper front portion. The guide plate or stencil guiding means 35 is supported by the support portions 27*f* and implemented by sheet metal having a substantially rectangular shape, as seen in a plan view. One end of the guide plate 35 is rotatably supported by the support portions 27*f* via a pair of stubs 36. The guide plate 35 is rotatable about the stubs 36 due to its own weight. As shown only in FIG. 2, a stop 37 is formed integrally with each of the support portions 27*f* in order to limit the downward movement of the guide plate 35.

Two stepped pins 29 are studded on the outer periphery of each support portion 27*f* and spaced from each other in the up-and-down direction. An elongate flat roller arm 43 extends over the guide plate 35 and the outer peripheries of the support portions 27*f*. The roller arm 43 is formed with a vertically extending slot 43*b* at each of its opposite lower portions. The two pins 29 studded on each support portion 27*f* are loosely received in the corresponding slot 43*b*. The roller arm 43 is implemented by sheet metal. A knob 43*a* protrudes upward from the upper portion of the roller arm 43. In this configuration, the roller arm 43 is supported and guided by the pins 29 in such a manner as to be movable up and down within the range defined by the right and left slots 43*b*.

The pay-out roller or stencil conveying means 40 is formed integrally with a shaft 41 and rotatably supported by opposite upper portions of the roller arm 43. The pay-out roller 40 pays out the stencil 22 in contact with the guide plate 35 with the intermediary of the leading edge of the stencil 22. A roller gear 42 is affixed to the end of the shaft 41 protruding to the right, as seen in FIG. 3, through the upper portion of the roller arm 43. The pay-out roller 40 is formed of, e.g., foam chloroprene rubber, foam polyurethane rubber or similar sponge.

The pay-out roller 40 rests on the guide plate 35 due to its own weight and the weight of the roller arm 43 while following the movement of the plate 35 via the pins 29 and guide slots 43*b*. After the operator has pulled out the stencil holding unit 21 from the operative position to the inoperative position, the operator can lift the roller arm 43 and pay-out roller 40 by holding the knob 43*a*, pull out the leading edge of the stencil 22 from the roll 23, and then lay it on the guide plate 35.

Figure 6:
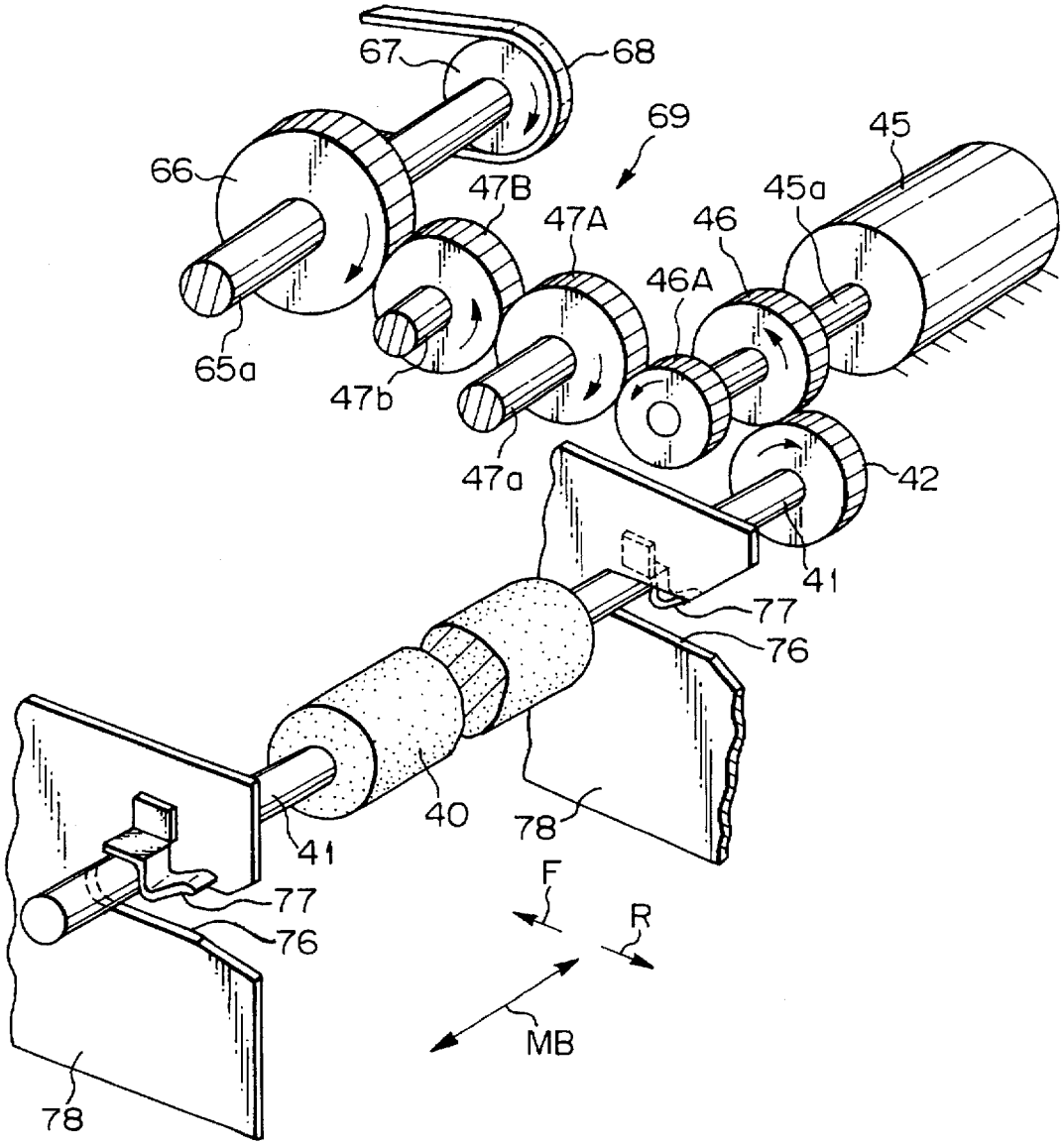
FIG. 6 is a fragmentary perspective view showing the stencil holding unit located at its operative position together with a motor and a drive transmission mechanism.

As shown only in FIG. 6, a motor 45 serves as stencil drive means for selectively causing the pay-out roller 40 to rotate. The motor 45 is implemented as a stepping motor and mounted on a stationary member formed integrally with the right side wall 78, as seen in FIG. 6. A drive gear 46 and a drive gear 46A smaller in diameter than the gear 46 are mounted on the output shaft 45*a* of the motor 45. The drive gear 46 selectively meshes with the roller gear 42. The drive gear 46A transfers the rotation of the motor 45 to a platen roller 65.

When the stencil holding unit 21 is brought to the operative position, the opposite ends of the shaft 41 are guided and supported by notches 76 formed in the opposite side walls 78. Each notch 76 is flared outward at its open end so as to facilitate the insertion of the shaft 41. A leaf spring 77 is affixed to the outer periphery of each side wall 78 above and in close proximity to the notch 76. The leaf spring 77 is bent in a unique configuration, as illustrated. Such leaf springs 77 hold the opposite ends of the shaft 41 at the inner ends of the notches 76 in a clicking fashion.

In the above construction, when the stencil holding unit 21 is brought to the operative position, the rotation of the motor 45 is transmitted to the pay-out roller 40 via the drive gear 46, roller gear 42, and shaft 41. when the unit 21 is pulled out to the inoperative position, the drive transmission from the motor 45 is interrupted.

Figure 7:
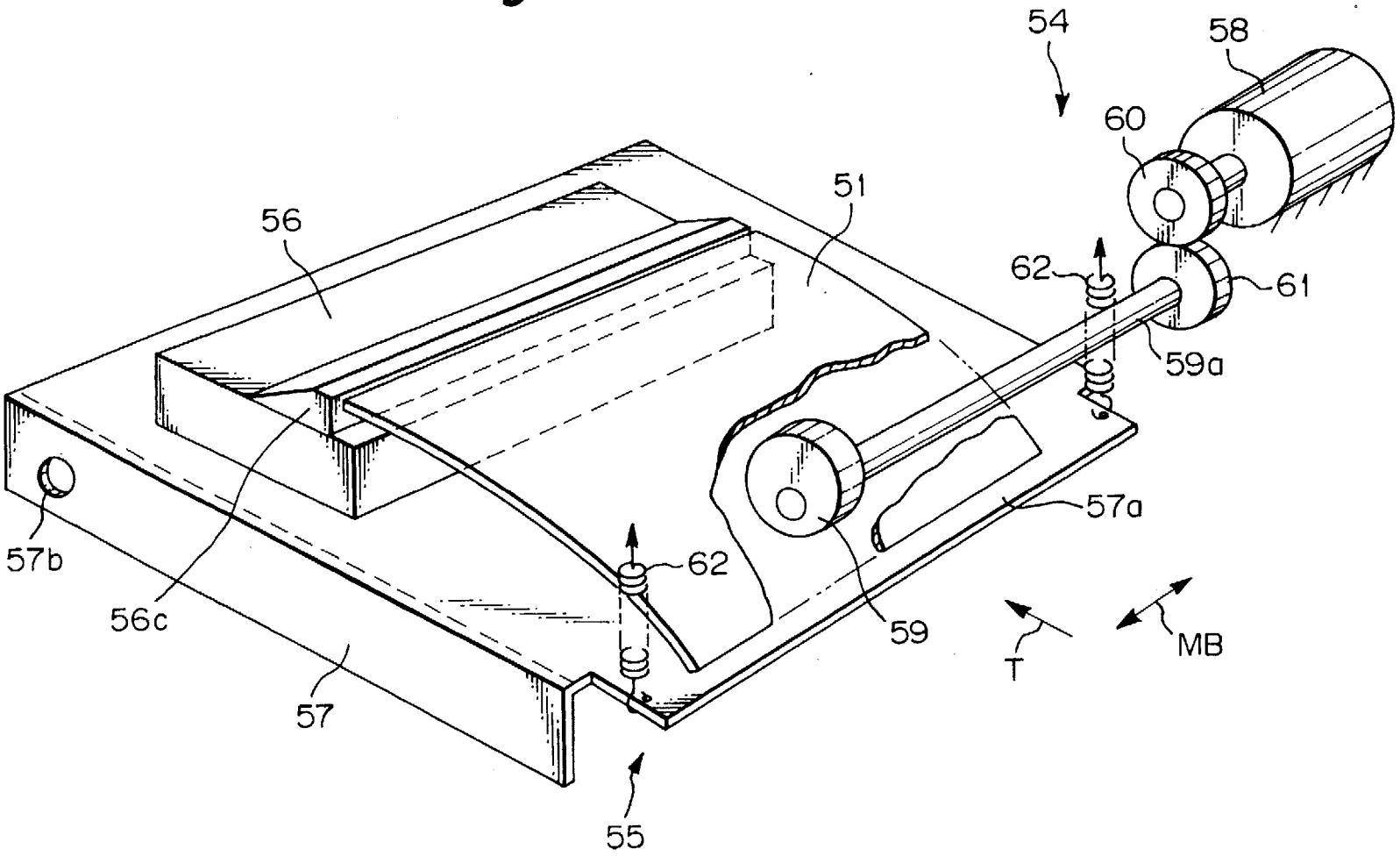
FIG. 7 is a fragmentary external perspective view showing platen pressure control means included in the first embodiment.

As shown in FIGS. 1 and 2, the platen pressure control section 55 is positioned on the stencil transport path MR downstream of the stencil holding unit 21. As shown in FIGS. 2 and 7, the control section 55 has a thermal head 56 and platen pressure control means 54 in addition to the platen roller 65. The platen roller 65 conveys the stencil 22 being paid out by the pay-out roller 40 or a stencil or master 22 perforated by the thermal head 56 to the downstream side of the path MR while pressing it against the head 56, as conventional. The platen roller 65 is formed of, e.g., silicone rubber and has a greater coefficient of friction than the pay-out roller 40 with respect to the stencil 22.

As shown only in FIG. 6, a drive transmission mechanism 69 transmits the rotation of the motor 45 to the platen roller 65, not shown. The mechanism 69 has a first idler gear 47A, a second idler gear 47B, and a platen roller gear 66. The idler gear 47A is mounted on a shaft 47*a* journalled to the right side wall 78, as seen in FIG. 6, and is held in mesh with the drive gear 46A. The idler gear 47B is mounted on a shaft 47*b* journalled to the right side wall 78 and is held in mesh with the idler gear 47A. The platen roller gear 66 is mounted on a shaft 65*a* journalled to the right side wall 78 and held in mesh with the idler gear 47B. The platen roller 65 is mounted on the shaft 65*a*. The mechanism 69 allows the motor 45 to additionally play the role of platen roller drive means for causing the platen roller 65 to rotate.

The platen roller 65 is caused to rotate at a slightly higher peripheral speed than the pay-out roller 40 via the above mechanism 69. This can be done by, e.g., adjusting the gear ratio (speed change ratio) between the adjoining gears and the outside diameters of the pay-out roller 40 and platen roller 65. In this condition, a preselected degree of tension acts on the stencil 22 between the roll 23 and the pay-out roller 40 and between the pay-out roller 40 and the platen roller 65. A platen roller pulley 67 is mounted on the end of the shaft 65*a*.

The thermal head 56 has a plurality of heating elements arranged in the main scanning direction, i.e., in the axial direction of the shaft 65*a*. The heating elements are selectively energized to cut or perforate the stencil 22 with heat, as conventional. The platen pressure control means 54 moves the head 56 into and out of contact with the platen roller 65. The control means 54 consists of a guide mount portion 57*a*, a pair of tension springs 62, an eccentric cam 59, a cam shaft 59*a*, a cam gear 61, a motor gear 60, and a motor 58.

A shaft 57*c* is passed through holes 57*b* formed in opposite side walls of a head base 57 and is supported by the right and left side walls 78, so that the base 57 is rotatable about the shaft 57*c*. The base 57 is implemented by sheet meal and provided with a bottom-open channel-like configuration. The guide mount portion 57*a* extends out from the end of the base 57 remote from the shaft 57*c*. The base 57 and guide mount portion 57*a* constitute a support member movably supporting the head 56. The cam or rotating member 59 selectively contacts the upper surface of the guide mount portion 57*a* and causes the base 57 and its portion 57*a* to rotate about the shaft 57*c*. The cam 59 is mounted on the cam shaft 59*a* while the cam gear 61 is mounted on the end of the shaft 59*a*. The cam 59 constitutes an angularly movable member angularly moving one of the head 56 and the platen roller 65.

The motor 58 is mounted on the side wall 78 and has the motor gear 60 held in mesh with the cam gear 61. The motor 58 causes the eccentric cam 59 to rotate. As shown only in FIG. 7, the tension springs 62 are loaded between the guide mount portion 57*a* and the upper portions of the side walls 78. The springs 62 constantly bias the head base 57 counterclockwise, as viewed in FIGS. 2 and 7. Only when the head 56 is spaced from the platen roller 65, the larger diameter portion of the cam 59 contacts the guide mount portion 57*a* of the head base 57. When the head 56 contacts the platen roller 65 with the intermediary of the stencil 22, the smaller diameter portion of the cam 59 faces the guide mount portion 57*a*, but is spaced from the same. In this condition, the pressure acting between the head 56 and the platen roller 65 via the stencil 22 is accurately determined only by the bias of the tension springs 62.

A head guide member 56*c* is mounted on the portion of the head 56 located at the free end side of the head base 57 and is implemented by a sheet of stainless steel by way of example. A guide member 51 is positioned on the stencil transport path MR between the position where the head 56 and platen roller 65 face each other and the guide plate 35. When the stencil holding unit 21 is located at the operative position shown in FIG. 1, the guide plate 35 is brought into engagement with the guide member 51. In this position, the guide member 51 plays the role of introducing means for introducing the leading edge of the stencil 22 being paid out by the pay-out roller 40 to a position adjoining the position where the head 56 and platen roller 65 face each other, and positioning it there. More specifically, the guide member 51 is affixed to the free end of the guide mount portion 57*a* and extends to a position adjoining the head guide member 56*c* over the cam 59. The guide member 51 may be implemented by sheet metal. The guide member 51 extends upward from the guide mount portion 57*a* toward the head guide member 56*c* while being sequentially bent. When the stencil holding unit 21 is pushed into the operative position in the direction F, the guide member 51 slidingly contacts the rear of the free end of the guide plate 35 and sequentially raises it. As a result, the free end of the guide plate 35 is brought to the vicinity of the position where the head 56 and platen roller 65 face each other.

The eccentric cam or rotating member 59 cancels the pressure or platen pressure acting between the head 56 and the platen roller 65. When the writing device 20 is out of operation, as shown in FIG. 2, the larger diameter portion of the cam 59 is pressed against the upper surface of the head base 57. In this condition, the head 56 mounted on the base 57 is retracted from the stencil transport path MR, so that the platen pressure acting on the stencil 22 is cancelled. When the head 56 is pressed against the platen roller 65 via the stencil 22, the roller 65 is rotated by the motor 45 via the mechanism 69 in order to convey the stencil 22 to the downstream side of the path MR.

To cut or perforate the stencil 22 being paid out from the roll 23, the cam 59 is rotated against the action of the springs 62 until its smaller diameter portion faces the upper portion of the guide mount portion 57*a* of the head base 57, but does not contact it. As a result, the free end of the base 57 is rotated counterclockwise about the shaft 57*c* due to the action of the springs 62, carrying the head 56 therewith. Therefore, the head 56 contacts the platen roller 65 with a predetermined pressure or platen pressure. In this condition, the stencil 22 is conveyed by the head 56 and platen roller 65 under the predetermined pressure. The head 56 selectively cuts the stencil 22 being conveyed with heat in both the main and subscanning directions. The main scanning direction is parallel to the axis of the shaft 65*a* while the subscanning direction corresponds to the stencil transport direction T.

The conveying force of the platen roller 65 determined by the bias of the springs 62, the output torque of the motor 45 and the coefficient of friction of the platen roller 65, among others, is selected to be slightly greater than the conveying force of the pay-out roller 40.

In the above embodiment, the head 56 is movable into and out of contact with the platen roller 65. Alternatively, the platen roller 65 may be moved into and out of contact with the head 56. This can be done if the mechanism for transferring the rotation of the motor 45 to the roller 65 is movable with tension pulleys and an endless belt, and if the roller 65 is caused to contact the head 56 by suitable means similar to the platen pressure control means 54. At the same time, an arrangement may be so made as to cause the free end of the guide plate 35 to adjoin the roller 65 when the stencil holding unit 21 is located at the operative position. The crux is that the stencil guiding means may be constructed such that the guide plate 35 adjoins or contacts one of the head 56 and platen roller 65 when the unit 21 is inserted as far as the operative position.

Not only during the above master making but also during the pay-out of the stencil 22 from the roll 23, the cam 59 may be continuously rotated for a short period of time on the arrival of the stencil 22. This allows the head 56 to repeatedly contact the platen roller 65 with the intermediary of the stencil 22. If the roller 65 is rotated in the stencil transport direction T in synchronism with such a movement of the head 56, then the stencil 22 located at the platen pressure control section 55 is pulled toward the downstream side in the direction T intermittently. Consequently, the friction acting between the friction portions 25*d* of the roll flanges 25*a* and 25*b* and the opposite ends of the roll 23 cooperate with the repeated contact of the head 56 with the roller 65 to smooth the portion of the stencil 22 paid out from the roll 23. As a result, the stencil 22 is freed from creases.

As shown in FIGS. 1 and 2, the cutting section 70 is positioned on the stencil transport path MR downstream of the platen pressure control section 55. The cutting section 70 has a rotary cutter or cutting means 71 and a guide rail 71A. The rotary cutter 71 cuts off the trailing edge of the stencil 22 perforated by the head 56 being conveyed by the platen roller 65, thereby producing a master 22. The guide rail 71A guides the reciprocating motion of the cutter 71 in the widthwise direction MB of the stencil 22. The cutter 71 is movable in the direction MB, i.e., across the stencil 22 while rotating about its own axis, as conventional. Usually, the cutter 71 is held in its stand-by position at one end of the guide rail 71A so as not to obstruct the movement of the stencil 22. The cutter 71 is caused to rotate and move by a motor 71B. The cutting section 70 with the cutter 71 and guide rail 71A may be implemented by an arrangement shown in, e.g., FIG. 1 of Japanese Patent Laid-Open Publication No. 7-101135. If desired, the rotary cutter 71 may be replaced with a guillotine type cutter having a stationary edge and an elevatable edge.

As shown in FIGS. 1 and 2, the first conveyor roller pair 72, a first guide 73, a second conveyor roller pair 74 and a second guide 75 are sequentially arranged in this order on the stencil transport path MR downstream of the cutting section 70. The first guide 73 guides the stencil or master 22 to the nip of the second roller pair 74 while the second guide 75 guides it toward the damper 4 of the drum 2.

The upper and lower rollers of the roller pair 72 are respectively mounted on shafts **72*a* and 72*b* to serve as a drive roller and a driven roller. The shafts 72*a* and 72*b* are journalled to the side walls 78. A roller pulley, not shown, is mounted on the end of the shaft 72*a* supported by the right side wall 78, as viewed in FIG. 6. An endless belt 68 is passed over the roller pulley the the platen roller pulley 67. A first roller pulley, not shown, is mounted on the shaft 72*a* outside of the above roller pulley. Likewise, the upper roller of the second roller pair 74 is a drive roller and mounted on a shaft 74*a*. The lower roller 74 is a driven roller and mounted on a shaft 74*b*. The shafts 74*a* and 74*b* are also journalled to the opposite side walls 78. A second roller pulley, not shown, is mounted on the end of the shaft 74*a* supported by the right side wall 78, as viewed in FIG. 6. An endless belt, not shown, is passed over the above first and second roller pulleys. The rollers 72 and 74** may be formed of rubber by way of example.

The first and second roller pulleys, endless belts, roller pulley, platen roller pulley 67, endless belt 68 and drive transmission mechanism 69 constitute a second drive transmission mechanism for transmitting the rotation of the motor 45 to the roller pair 74. Also, the second drive transmission mechanism constitutes a first drive transmission mechanism if the first and second roller pulleys and endless belt are removed therefrom. The first mechanism transfers the rotation of the motor 45 to the first roller pair 72. In this sense, the motor or stencil drive means 45 additionally plays the role of conveyor roller drive means for causing the roller pairs 72 and 74 to rotate.

The roller pair 74 is rotated at a slightly higher peripheral speed than the roller pair 72 via the second drive transmission mechanism. The roller pair 72 is rotated at a slightly higher peripheral speed than the platen roller 65 via the first drive transmission mechanism.

Further, the conveying force of the platen roller 65 acting on the stencil 22 is selected to be slightly greater than the conveying force of the roller pair 72 and that of the roller pair 74. Therefore, a preselected degree of tension acts on the stencil or master 22 between the platen roller 65 and the roller pair 72 and between the roller pairs 72 and 74. The relation between such peripheral speeds is adjusted on the basis of, e.g., the outside diameters of the platen roller pulley 67, above roller pulleys and platen roller 65, the outside diameter of the rollers 72, and the outside diameter of the rollers 74.

As stated above, in the illustrative embodiment, the pay-out roller 40, platen roller 65, roller pair 72 and roller pair 74 are sequentially slightly increased in peripheral speed in this order. As a result, a particular degree of tension acts on the stencil or master 22 between them. Therefore, a single stencil drive means, i.e., the stepping motor 45 suffices and provides the printer with a compact and inexpensive configuration.

The stencil or master 22 cut by the rotary cutter 71 at a preselected length is conveyed toward the damper 4 of the drum 2 by the arrangement following the cutting section 70. At this instant, the damper 4 is held in its stand-by position and causes it clamp member 4A to clamp the leading edge of the master 22.

The platen roller 65 and roller pairs 72 and 74 may be driven by any one of the following mechanisms in place of the drive transmission mechanism 69 and first and second drive transmission mechanisms, if the above advantages are not important. In one alternative mechanism, the mechanism 69 is omitted while an exclusive motor for driving the platen roller 65 is provided. This may be replaced with or combined with a mechanism in which the first and second drive transmission mechanisms are omitted, and an exclusive motor for driving one or both of the roller pairs 72 and 74 is provided. The mechanism 69 may be implemented by the combination of gears, belt and pulleys. This is also true with the first and second drive transmission mechanisms.

When the stencil holding unit 21 is located at the operative position, the overall length of the stencil transport path MR between the outermost end of the unit 21 and the second guide 75 is only about two-third of the path of a conventional master making device. The construction of the embodiment is therefore far more compact than the conventional construction.

Referring again to FIG. 1, a document reading section, not shown, is disposed in the upper portion of the printer 1 and includes a scanning portion. After a document has been laid on a glass platen included in the scanning portion, a light source illuminates it. The resulting imagewise reflection from the document is routed through optics, including mirrors and a lens, to a CCD (Charge Coupled Device) or similar image sensor. The image sensor outputs image data representative of the document image. The image data are sent to a control section, which will be described, and used to cut the stencil 22 at the master making device 20. An operation panel, which will be described, is positioned above the document reading section. The operator, standing by the operation panel, pulls and pushes the stencil holding unit 21, loads and unloads the roll 23, and sets the stencil 22 in the previously described manner.

The master discharging section 90 faces the image writing device 20 with the intermediary of the drum 2. The master discharging section 90 has an upper and a lower discharge member 91 and 92 and a box 94. The discharge members 91 and 92 adjoin the drum 2 and have belts contacting each other. The belts are each passed over a roller adjoining the drum 2 and a roller adjoining the box 94. The used master 22 is removed from the drum 2 by the belts and conveyed to the box 94 thereby. The lower discharge member 92 is capable of moving toward the circumference of the drum 2 when the drum 2 is rotated counterclockwise for discharging the used master 22. In this condition, the discharge member 92 is capable of receiving the trailing edge of the master 22 and conveying it toward the box 94.

A compressing member 93 is positioned above the box 94 and movable up and down. After the used master 22 has been discharged into the box 94, the compressing member 93 compresses it in order to prepare a space for accommodating the next used master 22. When the box 94 is filled with such waste masters 22, it is pulled out of the printer 1 in order to discard them.

A sheet separator 80 is positioned below and downstream of the drum 2 with respect to the clockwise rotation of the same (indicated by an arrow). The free end of the sheet separator 80 is movable toward and away from the circumference of the drum 2. The sheet separator 80 separates the sheet S from the drum 2 and causes it to reach a conveyor 81. The conveyor 81 has an endless belt 84 passed over a pair of rollers 82 and 83 and constitutes the sheet discharging section. The sheets S separated from the drum 2 are conveyed by the belt 84 to a tray 85. A fan 86 is positioned below the surface of the belt 84 on which the sheet S is carried. The fan 86 serves to hold the sheet S on the belt 84 by suction. The tray 85 may be configured to be rotatable about a shaft between an upright position and a flat position relative to the wall of the printer 1.

Figure 9:
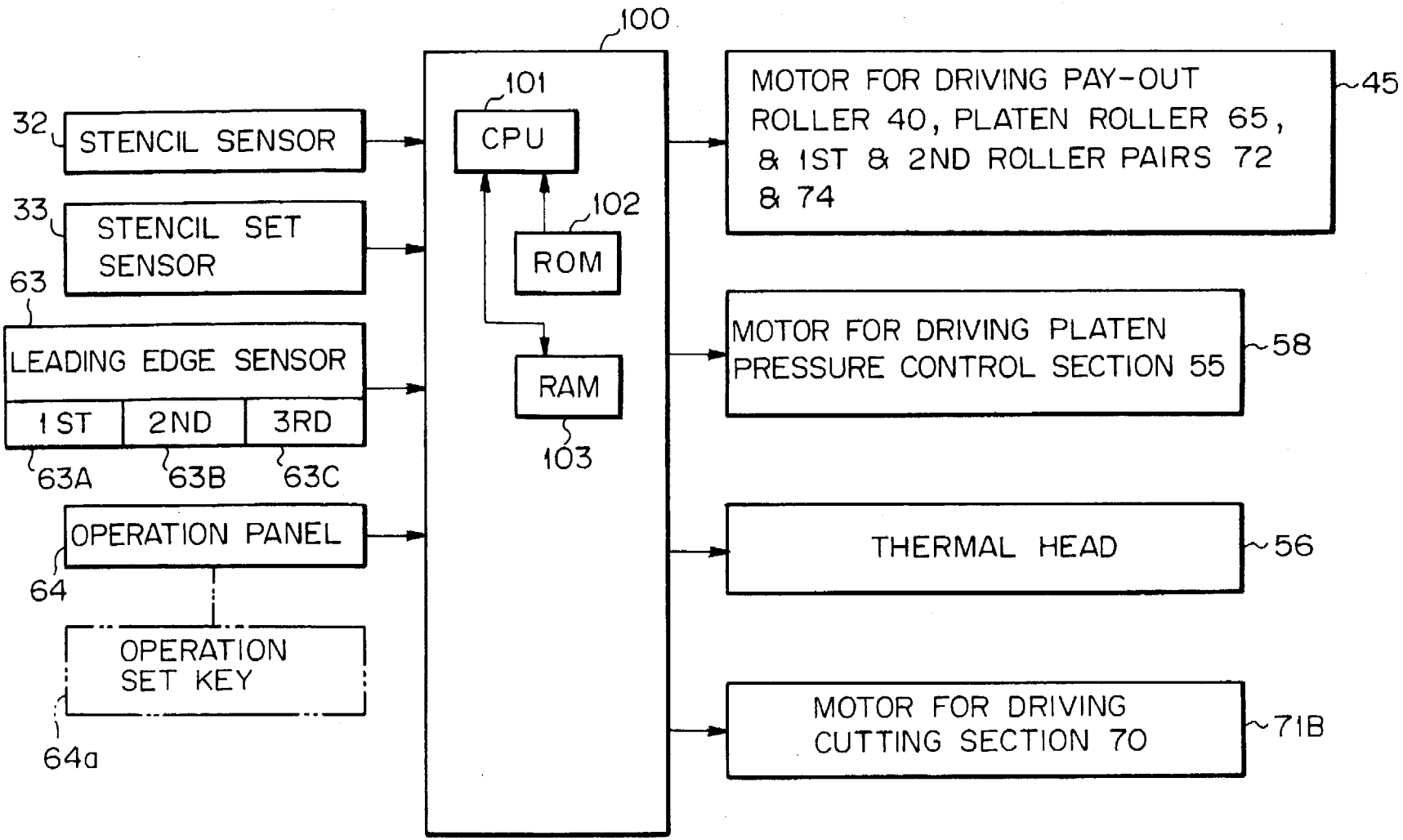
FIG. 9 is a block diagram schematically showing a control arrangement included in the first embodiment.

Referring to FIG. 9, a control section 100 is shown which executes various kinds of control including the control over the image writing device 20 based on the previously mentioned image data, and the control over the stencil feed. As shown, the control section or controller 100 has a CPU (Central Processing Unit) 101, a ROM (Read Only Memory) 102, and a RAM (Random Access Memory) 103. The ROM 102 stores a basic program for controlling the sequence beginning with the reading of a document image and ending with the discharge of the sheet S. The RAM 103 is used to register data.

The part of the controller 100 relevant to the crux of the illustrative embodiment will be described hereinafter. The document reading section, a stencil sensor or sensing means 32, a stencil set sensor or sensing means 33, a leading edge sensor or sensing means 63 and an operation panel 64 are connected to the input side of the control section 100 via an I/O (Input/Output) interface, not shown. Connected to the output side of the control section 100 are the motor 45 for driving the pay-out roller 40, platen roller 65 and first and second roller pairs 72 and 74, the motor 58 assigned to the platen pressure control section 55, the thermal head 56, and the motor 71B assigned to the cutting section 70. It is to be noted that an operation set key 64*a* enclosed by a dash-and-dots line is a control element which is not used in this embodiment.

As shown in FIGS. 1, 2 and 4, the stencil sensor 32 is implemented by a reflection type photosensor mounted on a stationary member, not shown, extending between the guide rails 79. The photosensor has a light emitting element and a light-sensitive element. When the roll 23 is loaded in the cavity 27*e* of the stencil holding unit 21, the sensor 32 may sense the roll 23 on the basis of a reflection from the roll 23. In addition, the sensor 32 is responsive to the limit or smallest usable diameter of the roll 23. When the roll 23 reaches its limit diameter due to the consumption of the stencil 22, the sensor 32 senses the low reflectance portion 23A and outputs a signal representative of the fall of reflectance. On receiving this signal, the controller 100 determines that the pay-out of the stencil 22 from the roll 23 must be stopped. Also, when the roll 23 is not loaded in the cavity 27*e*, the sensor 32 informs the control section 100 of the fall of reflectance.

The master set sensor 33 is responsive to the arrival of the stencil holding unit 21 at its operative position defined in the image writing device 20. In the illustrative embodiment, this sensor 33 is mounted on the bottom wall of the guide rail 79 of the body of the device 20. The sensor 33 is implemented as a microswitch which is operated by the bottom of the leading end of the slide rail 27*c* only when the unit 21 arrives at the operative position. The sensor 33 serves as operation sensing means for determining the time when the motor 45 should start operating, and feeds its output signal to the controller 100.

The microswitch 33 may be replaced with a reflection surface provided on the bottom of the leading edge of the slide rail 27*c*, and a reflection type photosensor mounted on the above wall of the guide rail 79.

As shown in FIGS. 1 and 2, the leading edge sensor 63 consists of a first sensor 63A, a second sensor 63B and a third sensor 63C. The first sensor 63A is positioned on the stencil feed path MR downstream of the guide member 51 in the stencil feed direction T, but upstream of the platen roller 65. The second sensor 63B is positioned on the path MR between the platen roller 65 and the cutting section 70. The third sensor 63C is positioned on the path MR between the two roller pairs 72 and 74. All the sensors 63A–63C are conventional reflection type photosensors each having a light emitting element and a photosensitive element.

On sensing the leading edge of the stencil 22, the second sensor 63B outputs a reference signal for driving the platen pressure control section 55. On detecting the leading edge of the stencil 22, the first and third sensors 63A and 63C each outputs a reference signal for causing the stencil 22 to be continuously paid out for a preselected period of time (corresponding to the number of steps of the motor 45). In response to the output signal of the sensor 63A, the stencil 22 is paid out in an amount great enough for the head 56 and platen roller 65 to nip the leading edge of the stencil 22, i.e., for the platen pressure to act on the leading edge. Likewise, in response to the output signal of the sensor 63C, the stencil 22 is paid out in an amount great enough for the leading edge thereof to face the damper 4.

A cut start switch, numeral keys for entering a desired number of printings and so forth are arranged on the operation panel 64. The cut start switch is pressed when a new perforated stencil or master 22 should be wrapped around the print drum 2. When this switch is pressed, the leading edge of the stencil 22 nipped between the guide plate 35 and the pay-out roller 40 is automatically paid out toward the platen pressure control section 55 and perforated. After the master 22 has been wrapped around the drum 2, a single sheet S is fed to the drum 2 while the ink is transferred to the sheet S via the perforations of the master 22. As a result, a single trial printing is produced. To start a sequence of printing operations, a print start switch, not shown, also provided on the operation panel 64 is pressed.

When the output signals of the stencil sensor 32 and stencil set sensor 33 are absent, the controller 100 does not energize the motor 45. At the same time, the control section 100 causes the motor 58 to rotate in the direction in which the larger diameter portion of the cam 59 contacts the end of the guide mount portion 57*a*, and stops the rotation of the platen roller 65. In this condition, the head 56 and platen roller 65 are spaced from each other and unable to convey or perforate the stencil 22. If desired, an LED (Light Emitting Diode) or similar indicating means may be provided on the operation panel 64 in order to inform the operator of the fact that the stencil holding unit 21 can be pulled out of the writing device 20. For example, the indicating means may blink when the unit 21 can be pulled out or glow when it cannot be pulled out.

On receiving the output signals of the stencil sensor 32 and stencil set sensor 33, the controller 100 energizes the motor 45 and thereby allows the stencil 22 nipped between the guide plate 35 and the pay-out roller 40 to be conveyed. When the first leading edge sensor 63A senses the leading edge of the stencil 22, the controller 100 causes the motor 45 to continuously rotate a preselected number of steps (pulses), thereby causing the pay-out roller 40 to make a preselected number of rotations corresponding to the above number of steps. As a result, the leading edge of the stencil 22 is moved toward the position where the head 56 and platen roller 65 face each other.

At the same time, the controller 100 controls the motor 58 such that the cam 59 moves the guide mount portion 57*a* toward the platen roller 65. As a result, the head 56 and platen roller 65 exert a force (platen pressure) on the stencil 22. Then, the motor 45 causes the platen roller 65 to rotate and convey the stencil 22 in cooperation with the head 56. The controller 100 causes the motor 45 to continuously rotate until the second leading edge sensor 63B senses the leading edge of the stencil 22. When the sensor 63B senses the leading edge of the stencil 22, it sends its output signal to the controller 100. In response, the controller 100 causes the motor 58 to rotate for a short period of time in order to rotate the cam 59 continuously (usually at least more than one rotation). Consequently, the head 56 and platen roller 65 contact each other intermittently while exerting the platen pressure on the stencil 22 intermittently.

Subsequently, the controller 100 further drives the motor 45 until the third leading edge sensor 63C senses the leading edge of the stencil 22. On receiving the output signal of the sensor 63C indicative of the leading edge, the control section 100 causes the motor 45 to rotate a preselected number of steps and thereby causes each of the pay-out roller 40, platen roller 65 and roller pairs 72 and 74 to make a number of rotations corresponding to the above number of steps. As a result, the leading edge of the stencil 22 is conveyed to a position where it faces the damper 4, as shown in FIG. 1. Thereafter, the control section 100 deenergizes the motor 45 and thereby sets up a stand-by condition, i.e., locates the leading edge of the stencil 22 at a position closest to the damper 4.

A reference will be made to FIGS. 10–19, 20 and 21 for describing the above sequence of operations beginning with the unloading and loading of the roll 23 and ending with the wrapping of the master 22 around the drum 2 more specifically. FIGS. 10–19 show the various arrangements slightly schematically, compared to the foregoing figures including FIGS. 1 and 2, for the simplicity of illustration. The constituent parts of the stencil holding unit 21, for example, are omitted, as the case may be.

Figure 10:
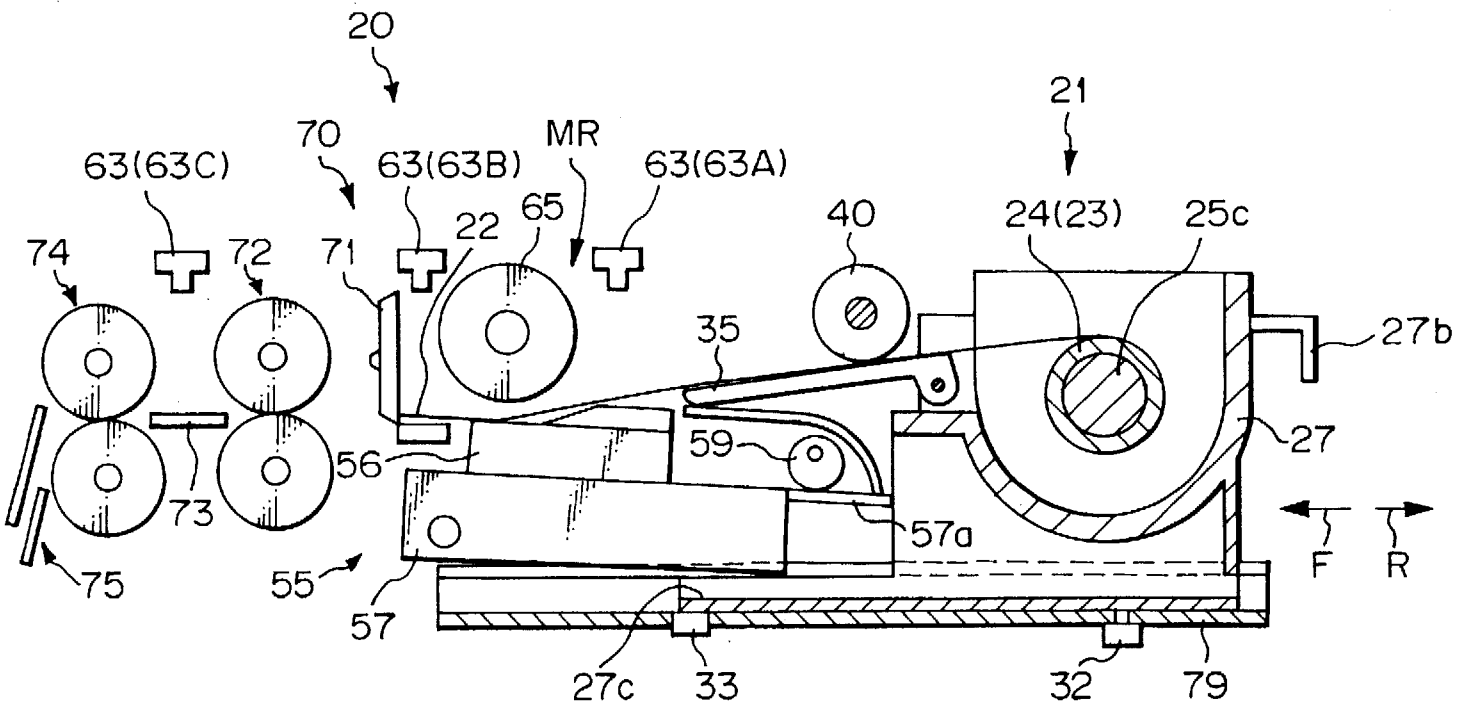
FIG. 10 shows the first embodiment in a condition wherein the stencil of the roll has been consumed.

FIG. 10 shows the stencil holding unit 21 in its operative position and not loaded with the roll 23 or loaded with the roll 23 reached its limit diameter. The absence of the roll 23 or the limit diameter of the same is sensed by the stencil sensor 32. Specifically, the diameter of the roll 23 sequentially decreases due to the consumption of the stencil 22 until it reaches the limit diameter. As a result, the light issuing from the stencil sensor 32 is not reflected due to the low reflectance portion 23A, FIG. 8. The sensor 32 sends its output representative of the fall of reflectance to the controller 100, as stated earlier. In response, the controller 100 sets up a condition for allowing the operator to pull out the stencil holding unit 21. Specifically, the control section 100 causes the motor 58 to rotate such that the larger diameter portion of the cam 59 contacts the guide mount portion 57*a* of the head base 57 against the action of the springs 62. As a result, the thermal head 56 is moved away from the platen roller 65 in order to cancel the pressure acting on the stencil 22.

Figure 11:
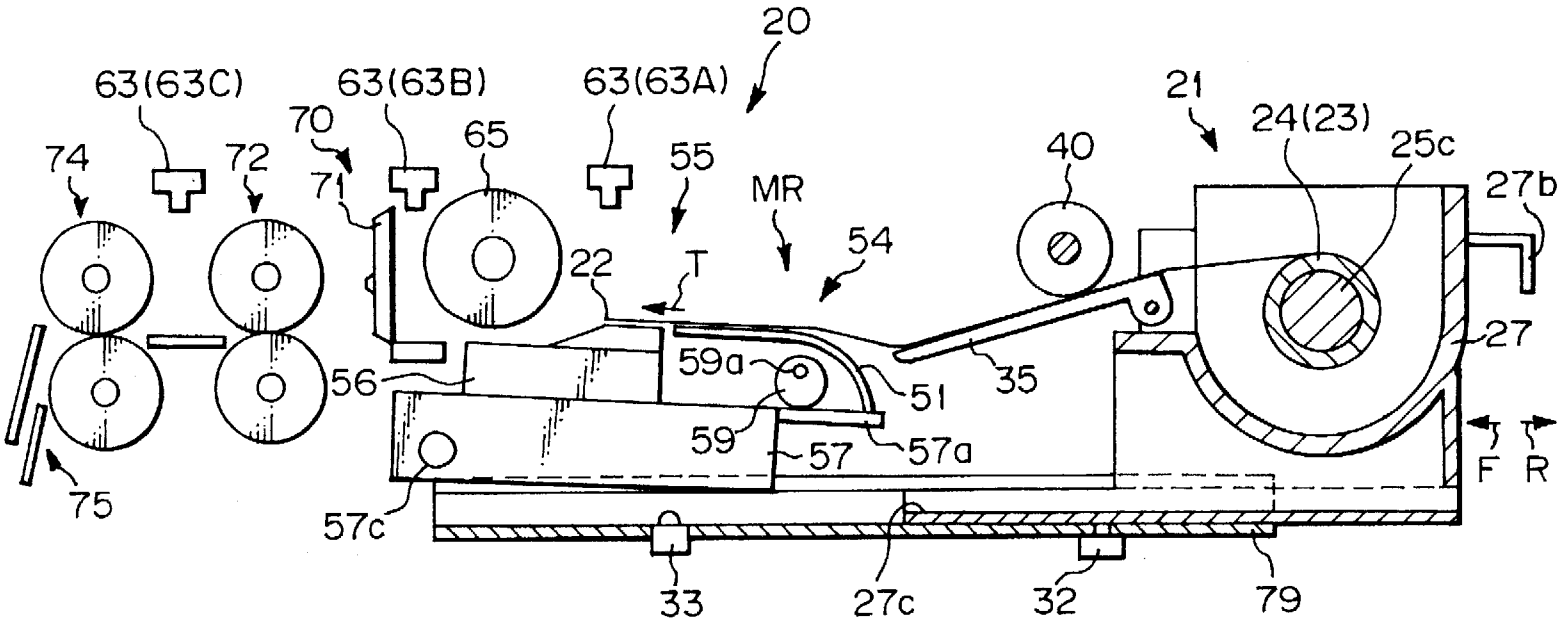
FIG. 11 shows the first embodiment in a condition wherein the stencil holding unit has been pulled out to its inoperative position for the replacement of the roll.

As shown in FIG. 11, when the operator holds the handle 27*b* of the roll holder 27, the stencil holding unit 21 is unlocked. Then, the operator pulls out the unit 21 in the direction R until it reaches its inoperative position. At this instant, the slide rails 27*c* of the roll holder 27 slide on the associated guide rails 79 of the side walls 78. When the unit 21 begins to be moved in the direction R, the shaft 41, FIG. 6, is released from the notches 76 against the action of the leaf springs 77 while the drive gear 46 and gear 42 are released from each other.

The inoperative position of the stencil holding unit 21 is such that the operator can load and unload the roll 23, and such that the operator can at least see the pay-out roller 40 and hold the knob 43*a* of the roller arm 43. Because the stencil 22 is free from the platen pressure of the platen pressure control section 55, no resistance acts against the outward movement of the unit 21. Further, in FIGS. 4 and 5, the slide portion 26*b* of the flange support plate 26 slidably contacting the slide guide portion 78*b* of the side wall 78 under the action of the spring 28 is released from the portion 78*b* due to the movement of the unit 21 in the direction R. Then, the inclined portion 26*a* of the flange support plate 26 is brought into sliding contact with the inclined guide portion 78*a* of the side wall 78. Consequently, the frustoconical portion 25*c* of the roll flange 25*b* is displaced from the advanced position where it is disposed in the tubular core 24 (dash-and-dots line, FIG. 4) to the retracted position (solid line, FIG. 4). The roll flange 25*b* is therefore released from the roll 23.

Figure 12:
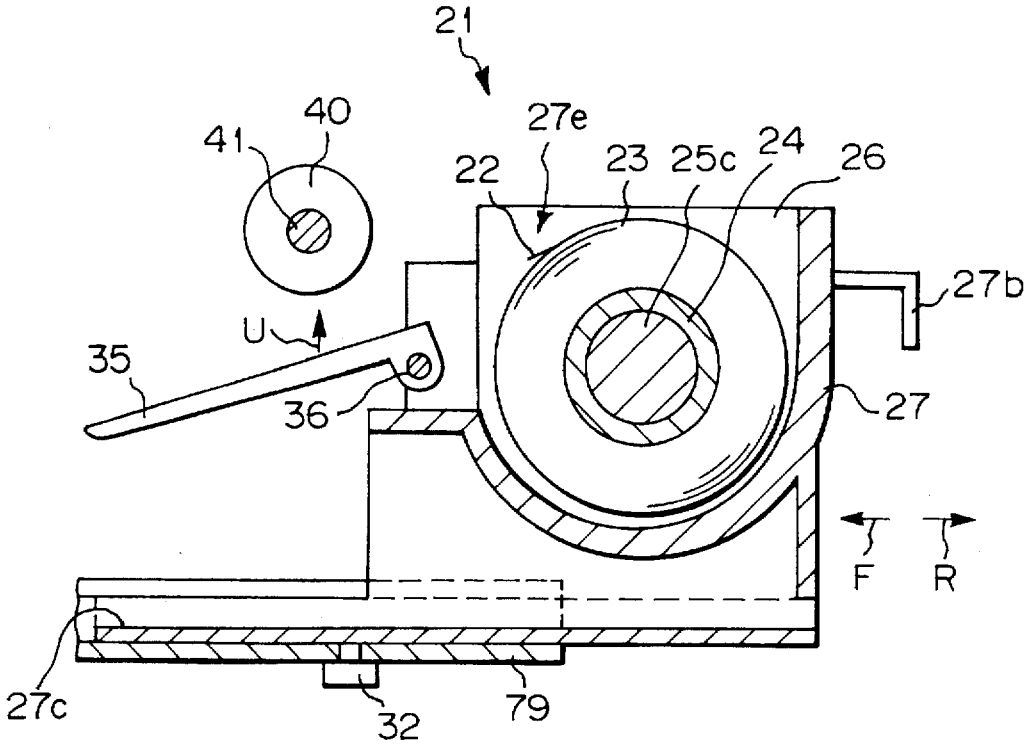
FIG. 12 shows the first embodiment in a condition wherein a new roll has been set in the cavity of the stencil holding unit.
Figure 13:
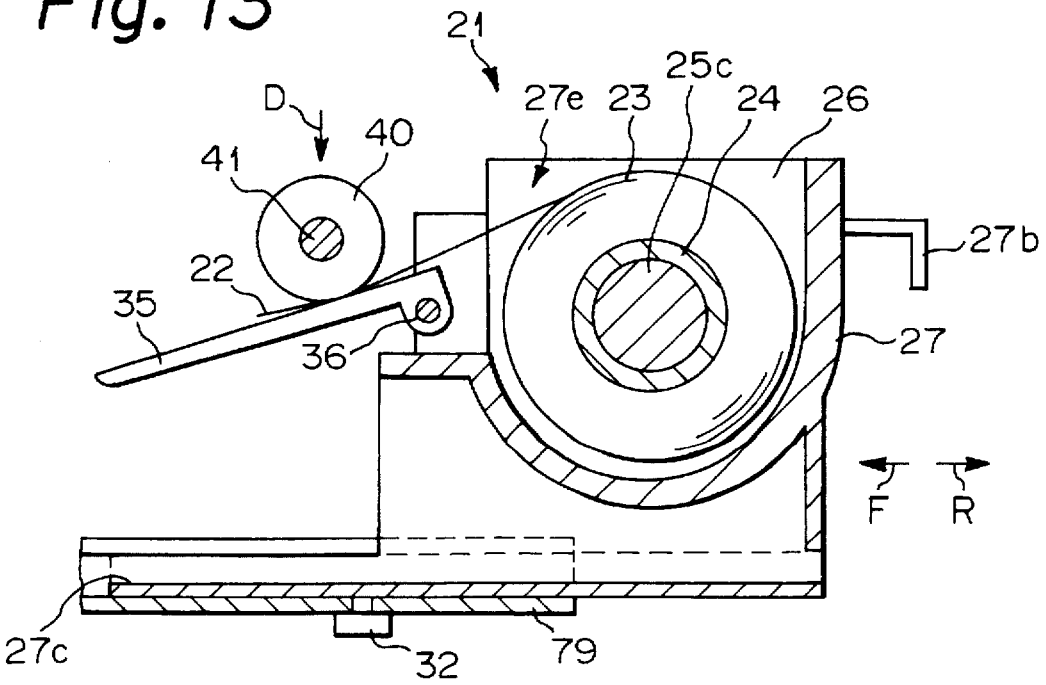
FIG. 13 shows the first embodiment in a condition wherein the leading edge of a stencil has been pulled out from the roll and nipped between a guide plate and a pay-out roller.

The operator removes the used roll 23 from the cavity 27*e* of the roll holder 27. Then, as shown in FIG. 12, the operator puts a new roll 23 in the cavity 27*e* of the roll holder 27 and couples the left end of the tubular core 24 of a new roll 23 over the frustoconical portion 25*c* of the roll flange 25*a*. Subsequently, as shown in FIGS. 3, 4 and 12, the operator pulls out the leading edge of the stencil 22 from the roll 23, lifts the roller arm 43 and pay-out roller 40 in the direction U by holding the knob 43*a*, and then lays it on the guide plate 35. Thereafter, the operator lowers the roller arm 43 and pay-out roller 40 in the direction D, as shown in FIG. 13. When the pay-out roller 40 rests on the guide plate 35 with the intermediary of the leading edge of the stencil 22, the stencil 22 is nipped between the guide plate 35 and the pay-out roller 40 due to the weights of the roller arm 43 and pay-out roller 40.

Figure 14:
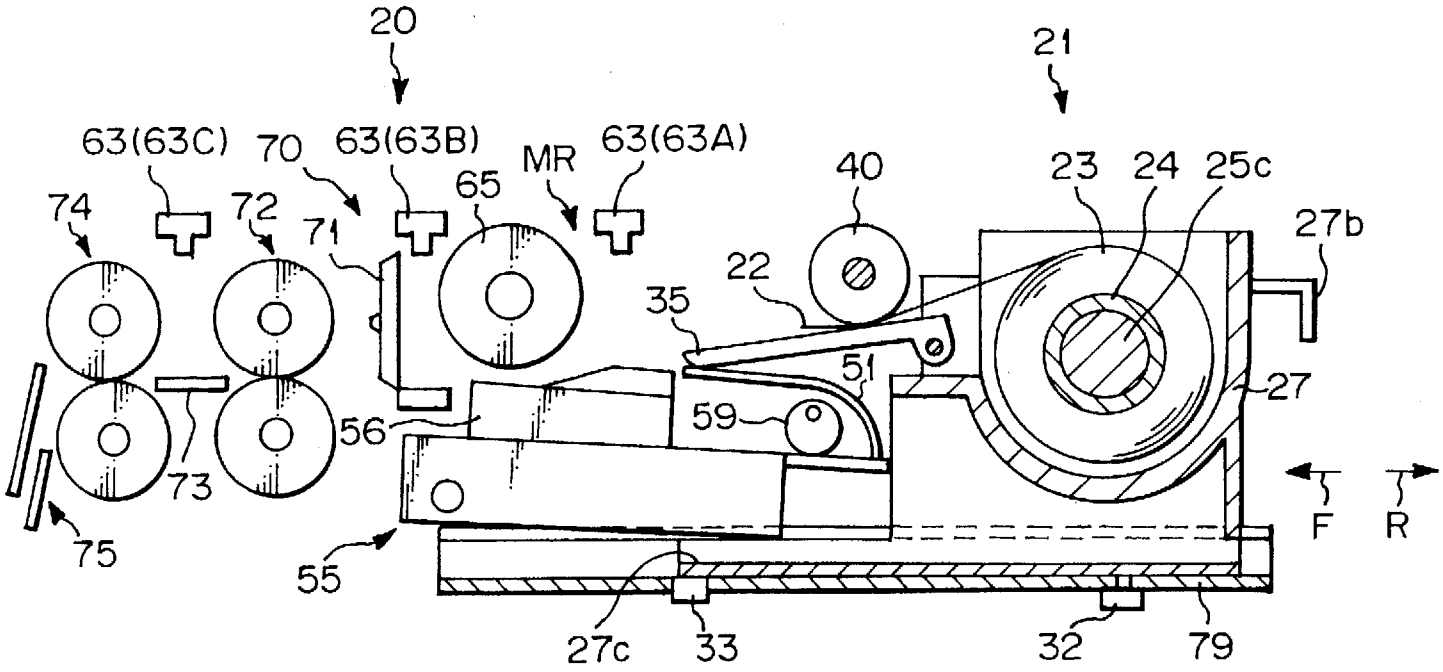
FIG. 14 shows the embodiment in a condition wherein the stencil holding unit has been brought to its operative position.

As shown in FIG. 14, the operator holds the handle 27*b* of the roll holder 27 and pushes the stencil holding unit 21 loaded with the new roll 23 into the image writing device 20 in the direction F against the action of the spring 28. Again, the slide rails 27*c* of the roll holder 27 slide on the guide rails 79 of the side walls 78. As shown in FIGS. 4 and 5, while the inclined guide portion 78*a* of the side wall 78 and the inclined portion 26*a* of the flange support plate 26 are released from each other, the slide guide portion 78*b* of the former and the slide portion 26*b* of the latter are brought into sliding contact. In FIGS. 4 and 5, the roll flange 25*b* is moved from the retracted position to the advanced position in parallel with the above movement of the unit 21. As a result, the frustoconical portion 25*c* of the roller flange 25*b* fully enters the core 24 while the friction portion 25*d* abuts against the adjoining end of the roll 23, positioning the roll 23 tridimensionally. In this manner, the roll 23 is rotatably supported by the roll flanges 25*a* and 25*b* and loaded in the unit 21 by a simple operation.

When the unit 21 slides in the direction F, the free end of the guide plate 35 slides on and along the guide member 51 toward the position where the platen roller 65 and head 56 face each other. When the unit 21 arrives at the operative position with the opposite ends of the shaft 41 guided by the notches 76, the ends of the shaft 41 abut against the deepest edges of the notches 76 against the action of the leaf springs 77. At the same time, the gear 42 is brought into mesh with the drive gear 46. In this condition, the stencil sensor 32 senses the new roll 23 while the stencil set sensor 33 senses the unit 21 located at the operative position.

Figure 15:
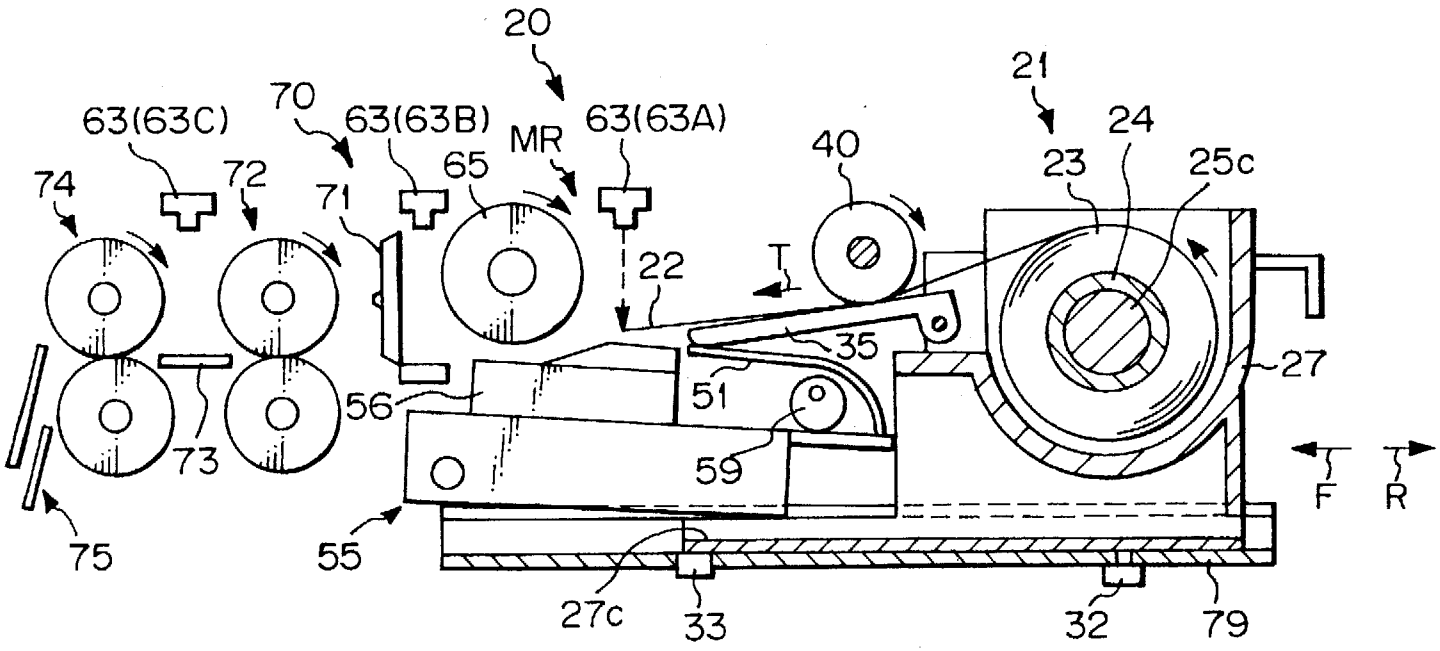
FIG. 15 shows the first embodiment in a condition wherein the stencil is being paid out by the pay-out roller.
Figure 16:
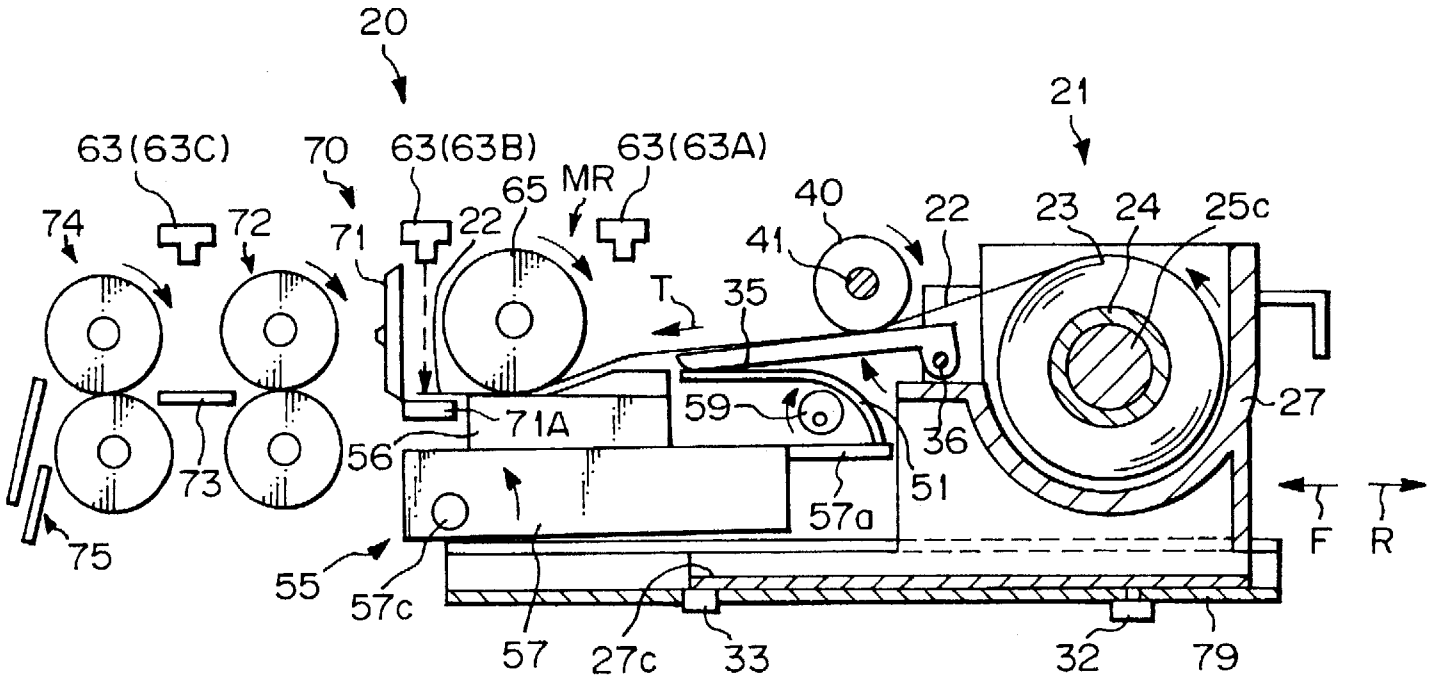
FIG. 16 shows the first embodiment in a condition wherein the stencil is being conveyed by the pay-out roller and platen roller.
Figure 20A:
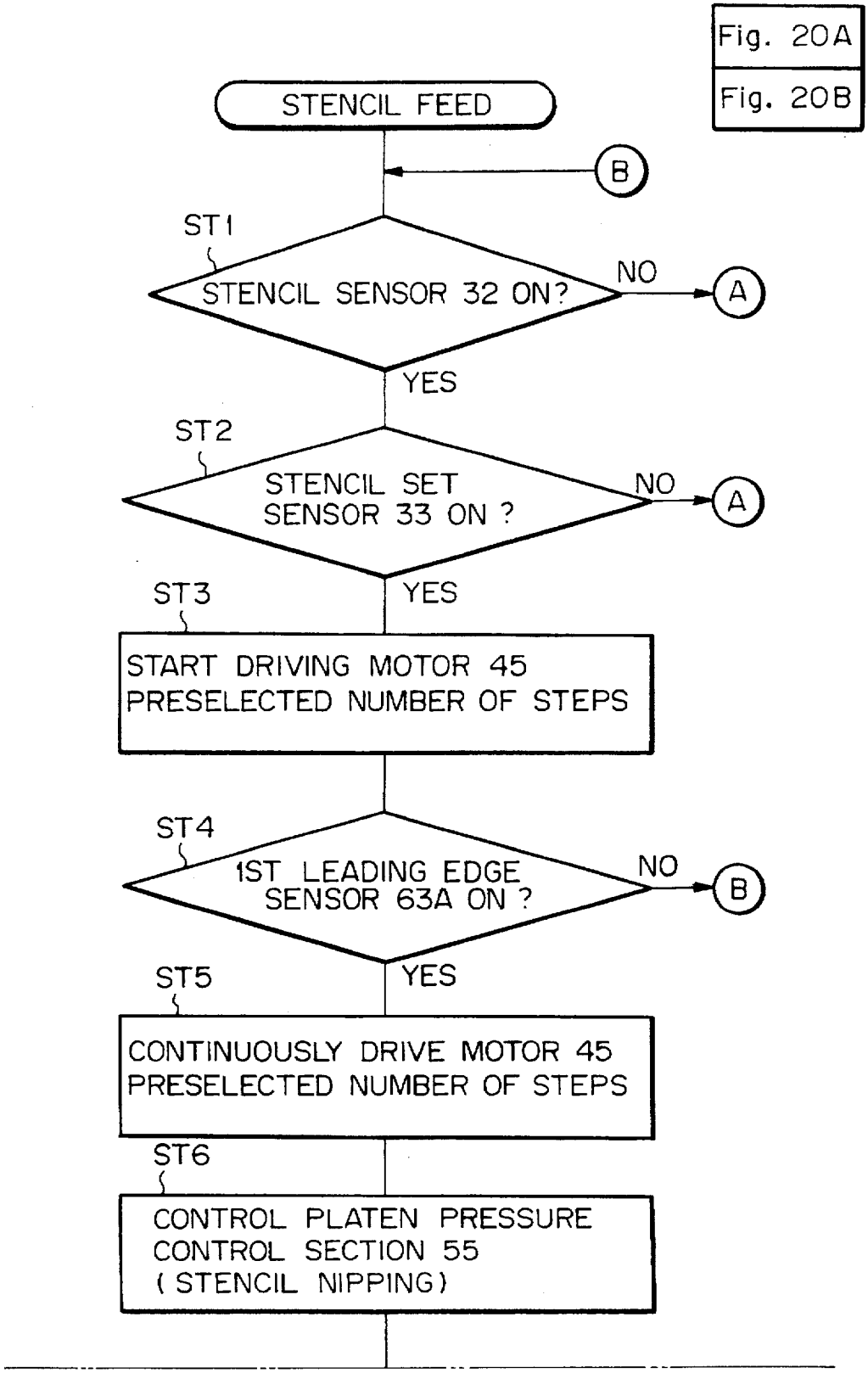
FIG. 20 is a flowchart demonstrating a specific operation of a control section included in the arrangement of FIG. 9.
Figure 20B:
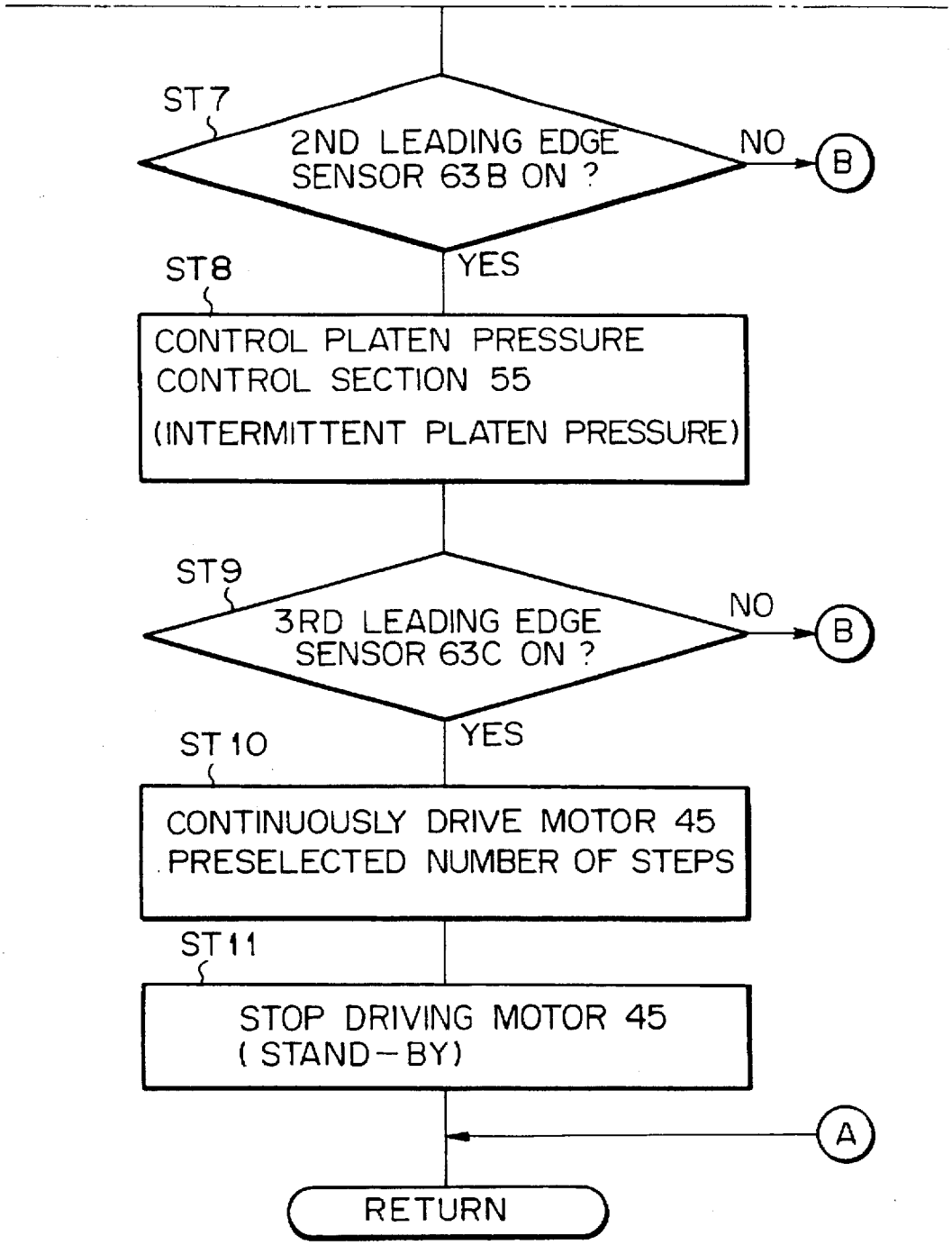

The controller 100 executes the routine shown in FIG. 20. In FIGS. 15 and 20, the controller 100 determines whether or not the stencil sensor 32 and stencil set sensor 33 have output their signals (ON) (steps ST1 and ST2). If the answer of the steps ST1 and ST2 are positive (Y), the controller 100 energizes the motor 45 with the result that the pay-out roller 40 is rotated clockwise. At the same time, the platen roller 65 is rotated clockwise via the drive transmission mechanism 69 while the conveyor roller pairs 72 and 74 are rotated clockwise via the first and second drive transmission mechanisms, respectively (step ST3). The pay-out roller 40 drives the leading edge of the stencil 22 nipped between it and the guide plate 35, so that the stencil 22 is paid out from the roll 23 rotating counterclockwise.

The stencil 22 is conveyed by the roller 40 to the downstream side in the stencil feed direction T while being guided by the guide plate 35.

The controller 100 determines whether or not the first leading edge sensor 63A has output its signal (ON) (step ST4) as soon as it starts driving the motor 45. If the answer of the step ST4 is negative (N) despite that the motor 45 has rotated the preselected number of steps, the controller 100 determines that a stencil feed error has occurred, e.g., the stencil 22 has jammed the stencil transport path MR. Then, the controller 100 drives an LCD (Liquid Crystal Display), not shown, provided on the operation panel 64, alerting the operator to the error. While this processing is implemented as a separate subroutine, it is represented by a transfer to a step B in FIG. 20 for convenience. Steps ST7 and ST9 are similar to the step ST4 and will not be described in order to avoid redundancy.

On receiving the output of the first leading edge sensor 63A, the controller 100 causes the motor 45 to continuously rotate a preselected number of steps (step ST5). This allows the leading edge of the stencil 22 to reach the pressing portion of the platen pressure control section 55 (sometimes referred to as a nip hereinafter), as stated earlier. In the illustrative embodiment, after the leading edge of the stencil 22 has been sensed by the first sensor 63A, it is conveyed about 25 mm until it moves away from the nip between the platen roller 65 and the head 56.

Subsequently, the controller 100 controls the platen pressure control section 55 (step ST6). Specifically, the controller 100 drives the motor 58 such that the cam 59 makes half a rotation and causes its smaller diameter portion to face the guide mount portion 57*a* while being spaced therefrom. As a result, the head base 57 is rotated counterclockwise about the shaft 57*c* due to the action of the springs 62, bringing the head 56 into contact with the platen roller 65 with the intermediary of the stencil 22. At the same time, the guide member 51 mounted on the guide mount portion 57*a* is raised while causing the free end of the guide plate 35 to slightly rotate clockwise about the shaft 36. At this instant, despite such a displacement of the guide plate 35, the shaft 41 moves little because the pay-out roller 40 is formed of sponge and deforms easily.

The platen roller 65 nipping the stencil 22 between it and the head 56 is rotated clockwise via the drive transmission mechanism 69 at a slightly higher peripheral speed than the pay-out roller 40. As a result, the stencil 22 is sequentially paid out from the roll 23 while slightly slipping on the pay-out roller 40 and guide plate 35. The leading edge of the stencil 22 is sequentially moved toward the downstream side in the stencil feed direction T while being guided by the guide rail 71A.

Subsequently, the controller 100 determines whether or not the second leading edge sensor 63B has output its signal (step ST7). If the answer of the step ST7 is Y, the controller 100 causes the motor 45 to continuously rotate a preselected number of steps. This causes the cam 59 to rotate for a short period of time (at least more than one rotation) and thereby causes the head 56 and platen roller 65 to contact each other intermittently, i.e., to exert the platen pressure on the stencil 22 intermittently. At this instant, the stencil 22 is paid out from the roll 23 only when the head 56 contacts the platen roller 65. Further, in FIGS. 16 and 17, the platen roller 65 is rotated clockwise in interlocked relation to the above operation, pulling the stencil 22 intermittently toward the downstream side. This successfully smooths the stencil 22 or corrects its skew (step ST8).

Figure 17:
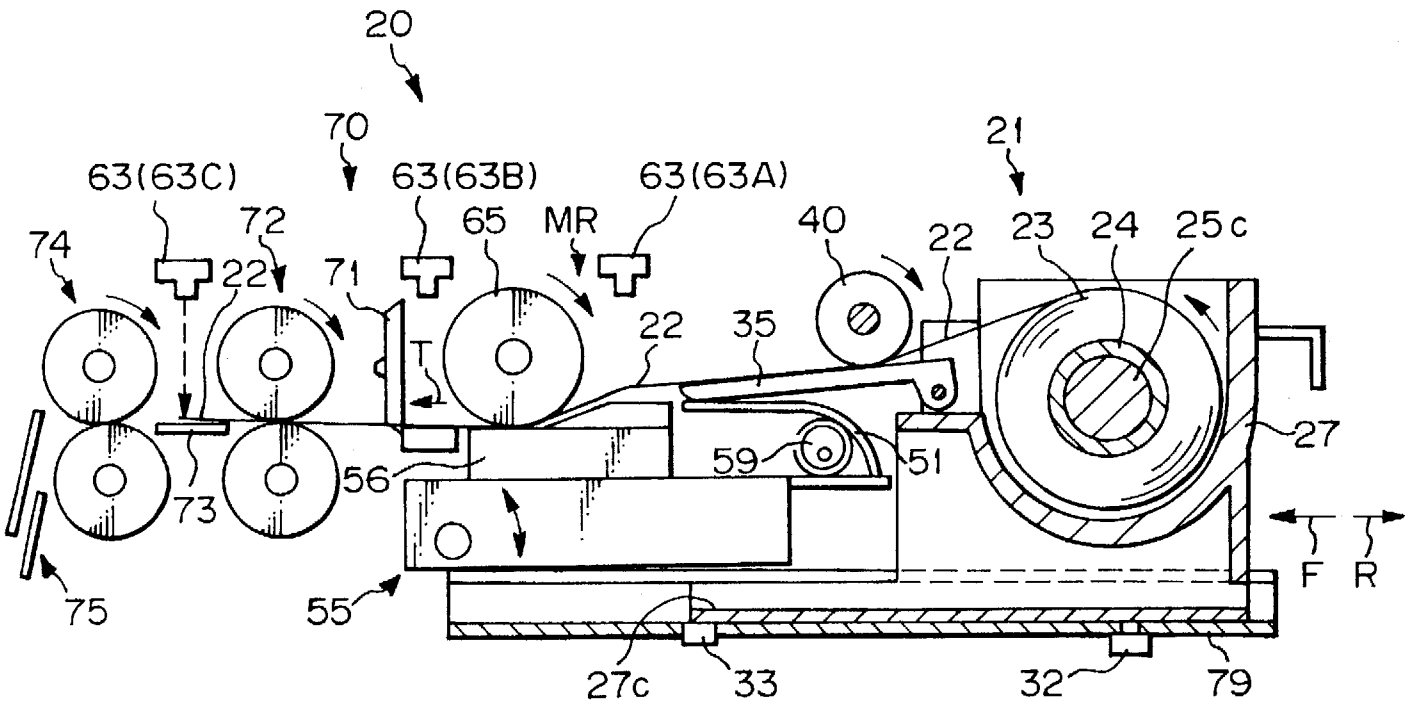
FIG. 17 shows the first embodiment in a condition wherein the stencil is being conveyed by the pay-out roller, platen roller, and a first conveyor roller pair.
Figure 18:
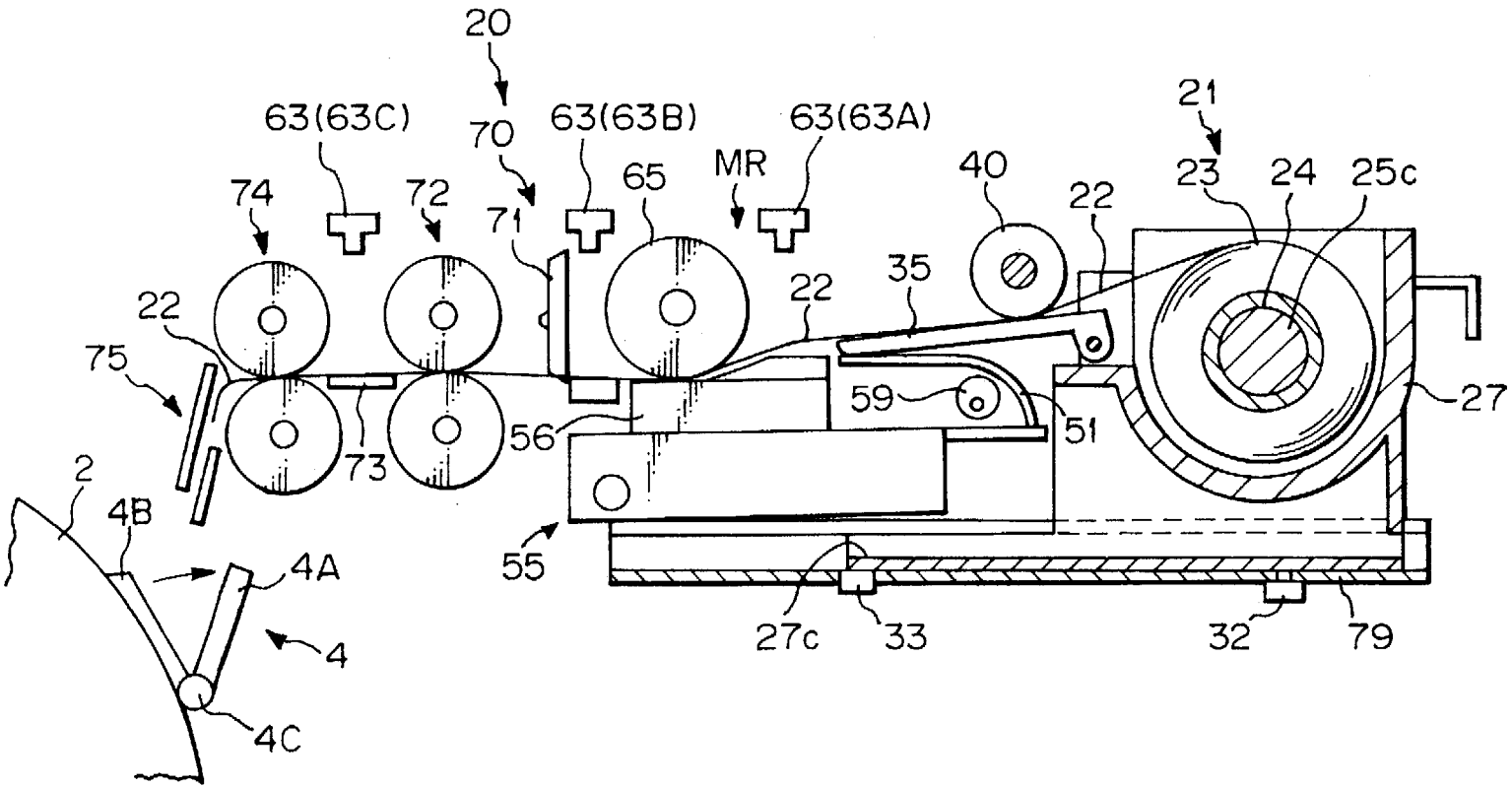
FIG.18 shows the first embodiment in a stand-by condition.

After the intermittent application of the platen pressure, the controller 100 causes the platen roller 65 to rotate clockwise at a slightly higher peripheral speed than the pay-out roller 40 via the drive transmission mechanism 65. Consequently, the stencil 22 is paid out from the roll 23 while slightly slipping between the pay-out roller 40 and the guide plate 35. In FIG. 17, the leading edge of the stencil 22 is conveyed toward the downstream side due to the further clockwise rotation of the roller pair 72 while being guided by the first guide 73. At this instant, the peripheral speed of the first roller pair 72 is higher than the peripheral speed of the platen roller 65, and the conveying force of the roller 65 acting on the stencil 22 is greater than the conveying force of the roller pair 72. Therefore, the roller pair 72 rotates to convey the stencil 22 being driven by the platen roller 65 toward the downstream side while slightly slipping on the stencil 22. The pay-out roller 40, platen roller 65 and roller pair 72 are continuously rotated by the motor 45 until the third leading edge sensor 63C senses the leading edge of the stencil 22.

The controller 100 determines whether or not the third sensor 63C has output its signal (step ST9). If the answer of the step ST9 is Y, the controller 100 causes the motor 45 to rotate a preselected number of steps and thereby causes the pay-out roller 40, platen roller 65 and first and second roller pairs 72 and 74 to feed the leading edge of the stencil 22 to the position where it faces the clamper 4 (step ST10), as shown in FIG. 17. At this instant, the roller pair 74 is rotated at a higher peripheral speed than the roller pair 72, and the platen roller 65 which exerts a greater conveying force on the stencil 22 than the roller pairs 72 and 74. Consequently, the roller pair 74 rotates to convey the stencil 22 being driven by the pay-out roller 40, platen roller 65 and roller pair 72 toward the downstream side while slightly slipping on the stencil 22.

After the step ST10, the controller 100 deenergizes the motor 45 and sets up the previously mentioned stand-by condition (step ST11). In the illustrative embodiment, after the leading edge of the stencil 22 has been sensed by the third leading edge sensor 63C, it is moved about 30 mm until it reaches the above stand-by condition.

Figure 19:
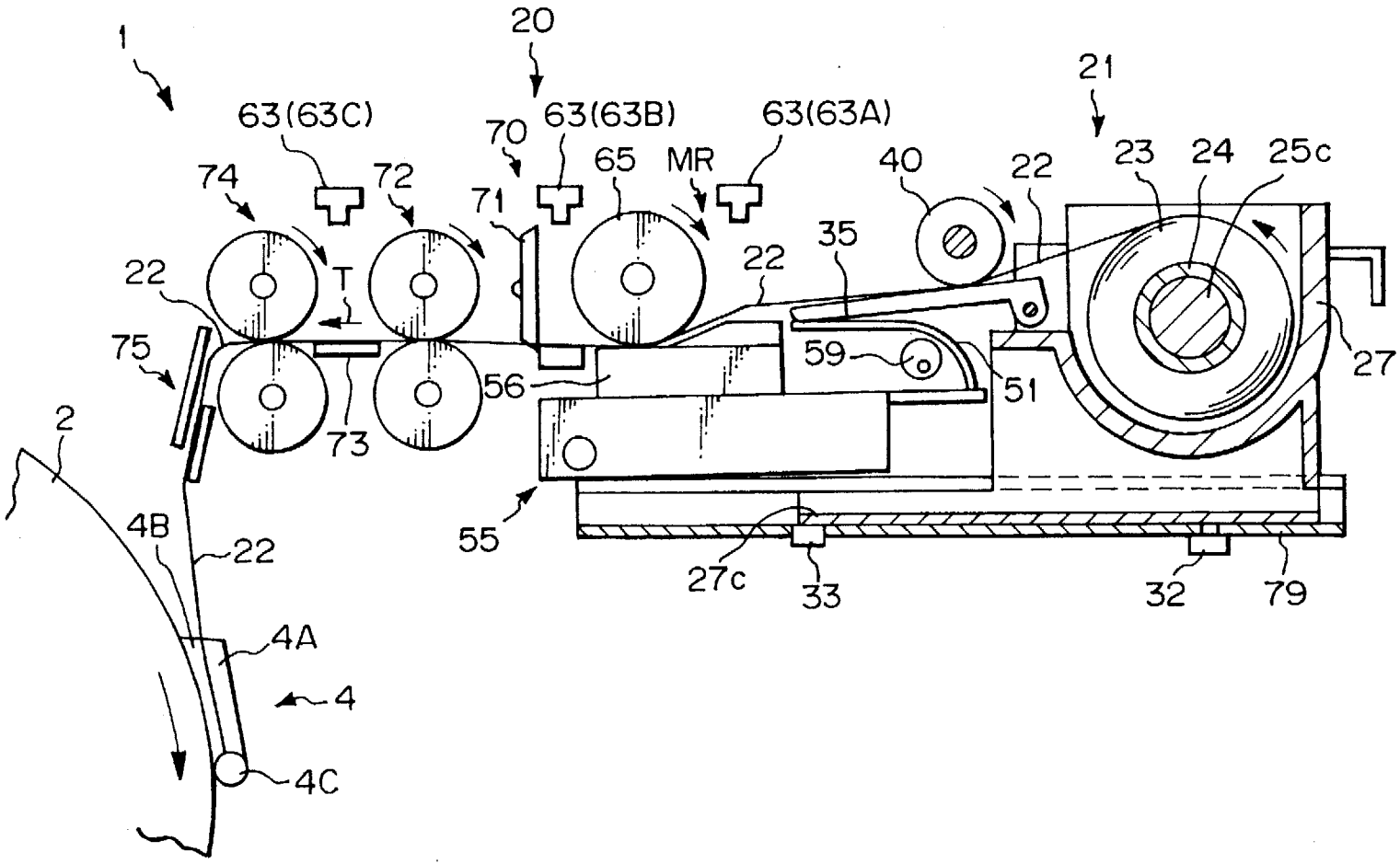
FIG. 19 shows the first embodiment in a condition wherein the stencil conveyed by the pay-out roller, platen roller and first conveyor roller pair and a second conveyor roller pair is being wrapped around a drum.

In the above condition, the operator presses the cut start switch. In response to a signal output from the switch, the controller 100 causes the heating elements of the head 65 to selectively generate heat in accordance with image data output from the document reading section and digitized. As a result, the head 56 sequentially cuts or perforates the stencil 22 with heat. In parallel with the cutting operation, the controller 100 drives the motor 45 and therefore the pay-out roller 40, platen roller 65 and two roller pairs 72 and 74. As a result, the leading edge of the cut stencil 22 is conveyed toward the clamper 4 along the second guide 75. The drum 2 is brought to a stop at a position shown in FIGS. 1 and 18 for receiving the stencil 22, and then the clamp member 4A of the clamper 4 is opened away from the stage 4B. As soon as the leading edge of the cut stencil or master 22 reaches the gap between the clamp member 4A and the stage 4B, the clamp member 4A is closed to nip the leading edge between it and the stage 4B, as shown in FIG. 19. Subsequently, the drum 2 is rotated clockwise either continuously or intermittently, so that the master 22 is sequentially wrapped around the drum 2.

Figure 21:
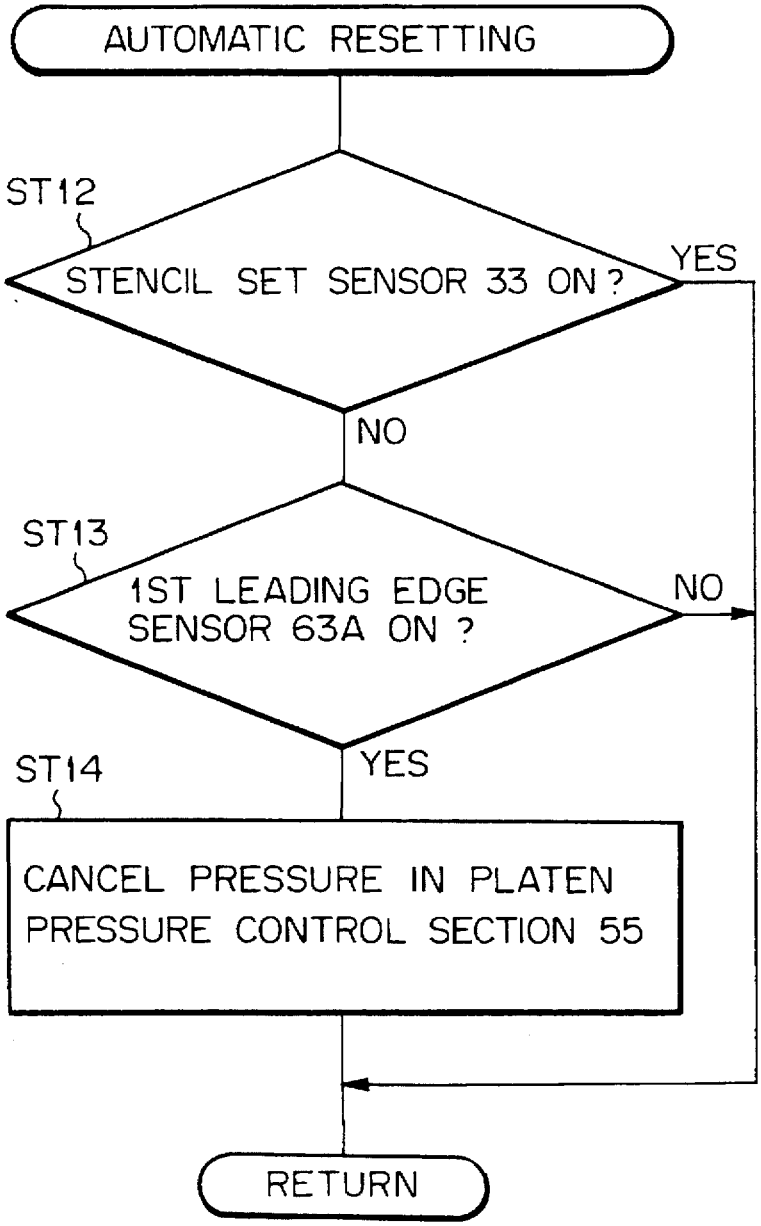
FIG. 21 is a flowchart representative of an automatic resetting procedure to be executed by the control section.

FIG. 21 shows a procedure for cancelling the pressure acting on the stencil 22 in the platen pressure control section 55 (labeled AUTOMATIC RESETTING). When the stencil holding unit 21 is moved outward away from the operative position, the procedure to be described cancels the pressure and allows the unit 21 to be smoothly pulled out. As shown, the controller 100 determines whether or not it has received the output signals of the stencil set sensor 33 and first leading edge sensor 63A (steps ST12 and ST13). If the answer of the step ST12 is N, but if the answer of the step ST13 is Y, the controller 100 causes the platen pressure control section 55 to cancel the pressure acting on the stencil 22 (step ST14).

In the step ST14, the motor 58 rotates to cause the larger diameter portion of the cam 59 to contact the guide mount portion **57*a* of the head base 57. As a result, the head 56 is released from the platen roller 65, cancelling the pressure on the stencil 22. Even if the stencil 22 is nipped when the stencil holding unit 21 starts moving toward the outside of the writing device 20, tension acts on the stencil 22 and causes the roll 23 to rotate in the cavity 27*e* while loosening itself. Therefore, despite the pressure acting on the stencil 22, the stencil 22 is prevented from being cut away from the roll 23**.

Subsequently, during the course of printing, every time the used master 22 is discharged from the drum 2, the stencil 22 is paid out from the roll 23, cut, and then wrapped around the drum 2 in order to effect another printing operation.

1st Modification

Figure 22:
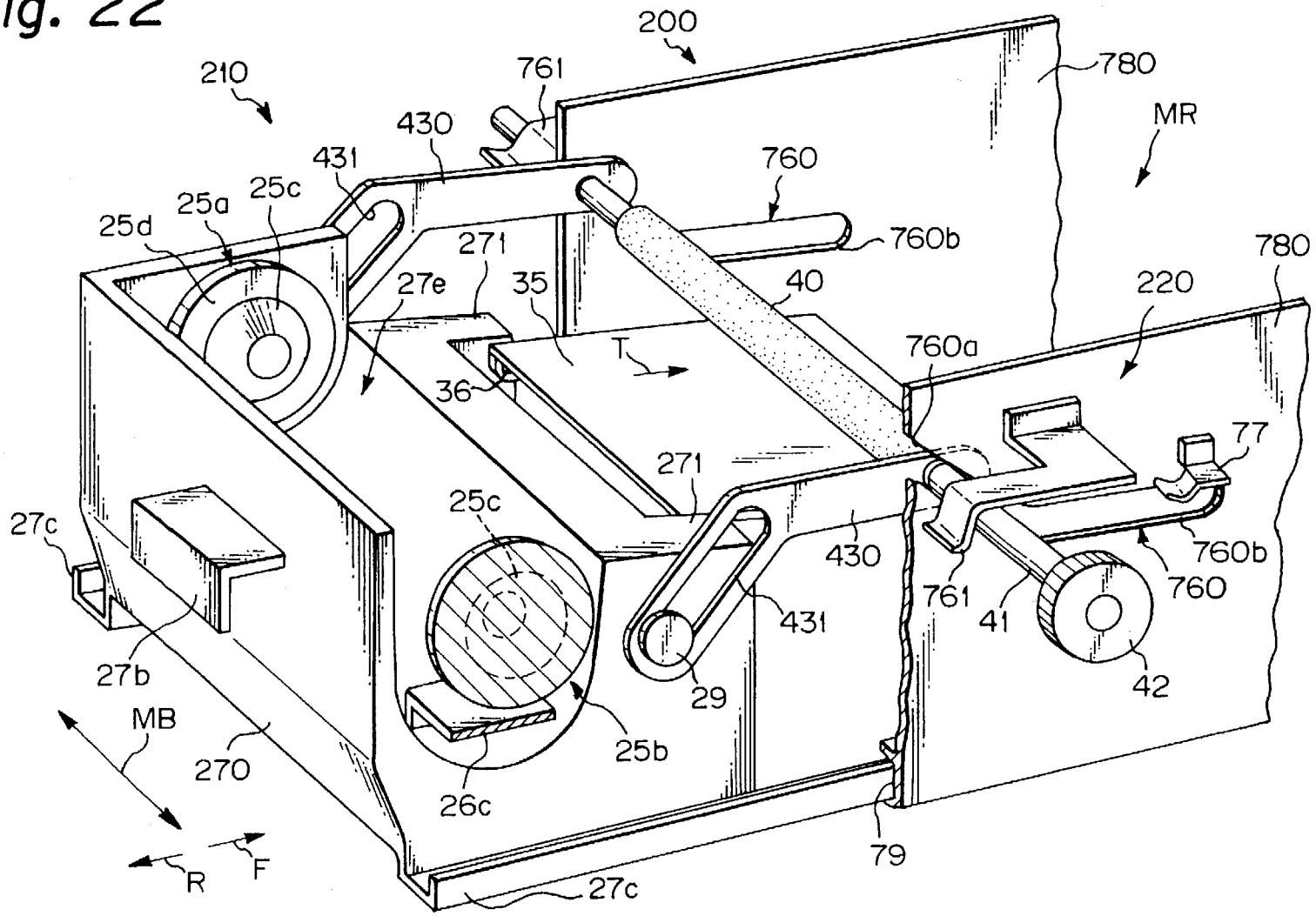
FIGS. 22 and 23 are respectively a fragmentary perspective view and a fragmentary front view showing a first modification of the first embodiment.
Figure 23:
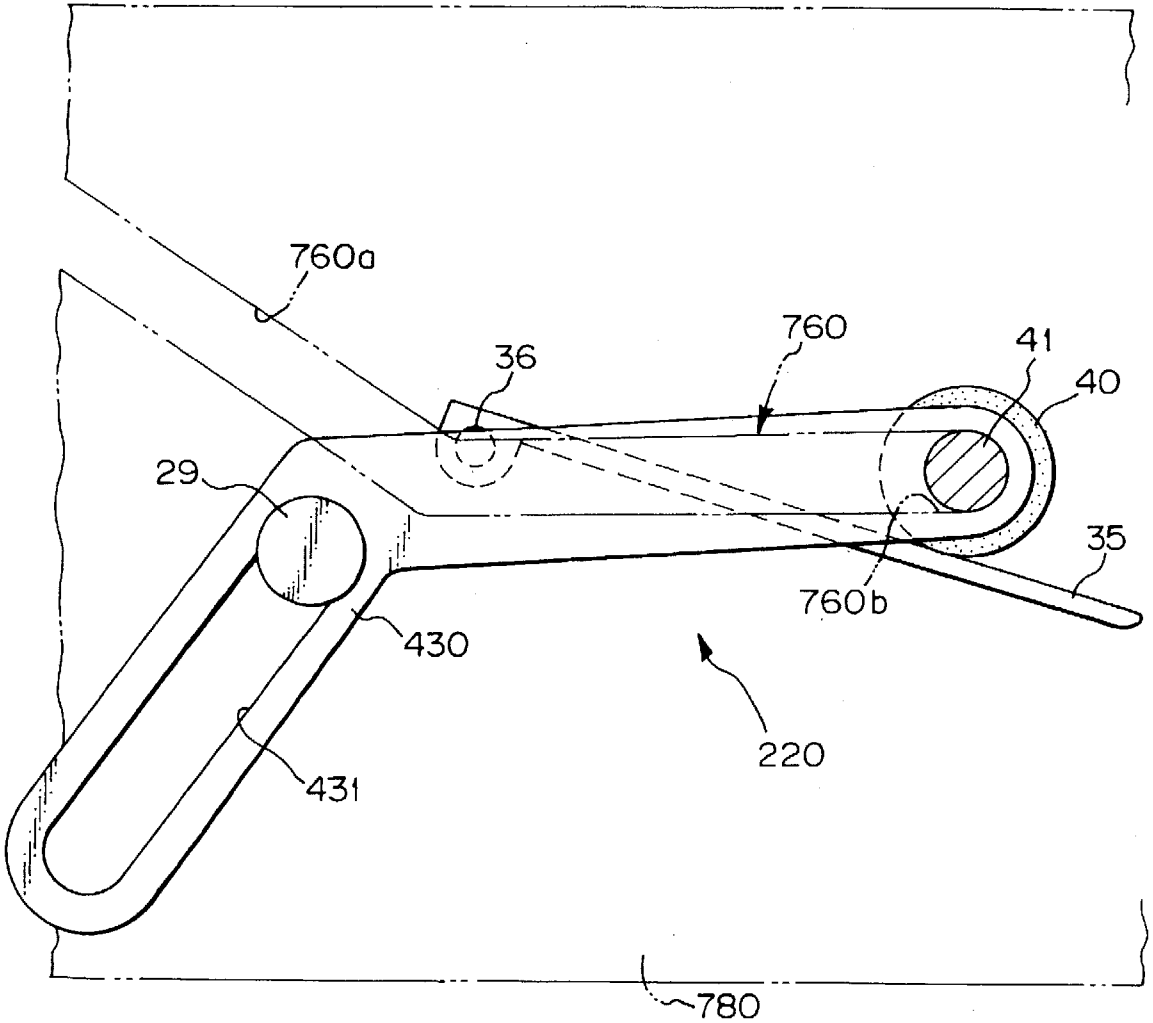

FIGS. 22 and 23 show a first modification of the first embodiment described above. The modification is identical with the first embodiment except that an image writing device 200 is substituted for the device 20. As shown, the device 200 has a stencil holding unit 210 in place of the unit 21, and a pair of side walls 780 in place of the walls 78. The device 200 is characterized in that the pay-out roller 40 contacts the guide plate 35 when the stencil holding unit 210 is located at its operative position or leaves it when the unit 210 is located at its inoperative position. The following description will concentrate on the differences between the embodiment and the modification.

The stencil holding unit 210 has a pair of roller arms 430 supported by guide plate support portions 271 included in a roller holder 270. The roller arms 430 are movable in substantially the horizontal direction. Interlocked moving means 220 is associated with the side walls 780 and includes guide notches 760. Specifically, the roller arms 430 are positioned inward of the opposite side walls 780, and each is implemented by sheet metal and has an angled configuration. The shaft 41 is rotatably supported by one end of the roller arms 430. The stepped pins 29 are respectively loosely received in slots 431 formed in the other end of the roller arms 430. The slots 431 are so configured as to guarantee the movement of the stencil holding unit 210 to the inoperative position.

The interlocked moving means 220 causes the pay-out roller 40 to contact the guide plate 35 when the stencil holding unit 210 is brought to the operative position, or causes it to move away from the guide plate 35 when the unit 21 is brought to the inoperative position. The moving means 220 is mainly constituted by an inclined channel portion **760*a* and a horizontal channel portion 760*b* formed in each of the side walls 780. The inclined channel portion 760*a* is inclined downward while having an open end at the upper left position, as seen in FIGS. 22 and 23. The horizontal channel portion 760*b* is contiguous with the channel portion 760*a* and extends substantially horizontally. When the shaft 41 moves along the channel portions 760*a*, the pay-out roller 40 is moved away from the guide plate 35, when the shaft 41 moves along the channel portions 760*b*, the pay-out roller 40 is brought into contact with the guide plate 35. Of course, each channel portion 760*b* may be slightly inclined downward and rightward from its end adjoining the channel portion 760*a* to the other end where the leaf spring 77 is positioned, so that the pay-out roller 40 can sequentially contact the guide plate 35. A stop 761 is mounted on each side wall 780 in the vicinity of the open end of the channel portion 760*a* in order to prevent the roll holder 270 from slipping out of the guide rail 79 when the stencil holding unit 210 is brought to the inoperative position. The stop 761 is implemented by a leaf spring having preselected resiliency which allows the unit 210 to be removed from the body of the writing device 200 together with the roll holder 270 for, e.g., the maintenance of the device 200. When the unit 210 is held in the inoperative position shown in FIG. 22, the sum of the resistance acting between the guide rails 79 and the slide rails 27*c* and the resistance ascribable to the weight of the roll holder 270 is sufficiently greater than the force with which the roller arms 430 and pay-out roller 40 tend to slide downward along the channel portions 760*a* due to their weights. Therefore, it is not necessary for the stops 761 to retain the shaft 41** by a clicking fashion.

In the condition shown in FIG. 22, the operator removes the used roll 23 from the cavity **27*e* of the roll holder 270, sets a new roll 23 in the cavity 27*e*, and pulls out the leading edge of the stencil 22 in the manner described with reference to FIGS. 3, 4 and 12. Then, the operator lays the leading edge of the stencil 22 on the guide plate 35 at a position at least downward, in the stencil feed direction MR, of the position to which the interlocked moving means 220 guides the pay-out roller 40. Subsequently, the operator pushes the stencil holding unit 210 into the device 200 in the direction F by holding the handle 27*b* of the roll holder 270. First, the roll holder 270 moves a distance corresponding to the length of the guide slots 431 of the roller arms 430. As the roll holder 270 is pushed deeper into the device 200, the stepped pins 29 abut against the right ends of the guide slots 431, as shown in FIG. 23. As a result, the roller arms 430 and pay-out roller 40, i.e., the stencil holding unit 210 is moved in the direction F. As shown in FIG. 23, the pay-out roller 40 nips the leading edge of the stencil 22 between it and the guide plate 35 while the shaft 41 has its opposite ends guided by the channel portions 760***a* and 760*b*. Finally, the shaft 41 is rotatably retained by the deepest edges of the channel portions 760*b* and the leaf springs 77. This is the operative position of the stencil holding unit 210. At the same time, the gear 42 is brought into mesh with the drive gear 46, as in the first embodiment.

When the operator pulls out the roll holder 270 toward the inoperative position in the direction R by holding the handle 27*b*, only the roll holder 270 is moved in the direction R until the stepped pins 29 abut against the left edges of the guide slots 431 formed in the roller arms 430. At the same time, the gear 42 is released from the drive gear 46, as in the first embodiment. After the pins 29 have abutted against the above edges of the slots 431, the roller arms 430 and pay-out roller 40, i.e., the stencil holding unit 210 moves in the direction R together with the roll holder 270. When the opposite ends of the shaft 41 moved away from the deepest edges of the channel portions 760*b* slides along the channel portions 760*b* and 760*a*, the pay-out roller 40 is released from the guide plate 35. As a result, the pressure acting on the leading edge of the stencil 22 is cancelled. In parallel with the above movement, the slide rails 27*c* of the roll holder 270 slide on the guide rails 79 of the side walls 780. As shown in FIGS. 4 and 5, the inclined guide portion 78*a* (not shown in FIGS. 22 and 23) of the side wall 780 contacts the inclined portion 26*a* (not shown in FIGS. 22 and 23) of the flange support plate 26. As soon as the stencil holding unit 210 reaches the inoperative position, the roll flange 25*b* reaches the retracted position.

As stated above, when the stencil holding unit 210 arrives at the operative position or the inoperative position, the interlocked moving means 220 brings the pay-out roller 40 into or out of contact with the guide plate 35. The operator therefore should only pull out the leading edge of the stencil 22 from the roll 23 and lays it at the previously mentioned position on the guide plate 35. This makes it needless for the operator to lift the roller arms 43 and pay-out roller 40 in the direction U by holding the knob 43*a*, as shown in FIG. 12, or to return them in the direction D, as shown in FIG. 13.

2nd Modification

Figure 24:
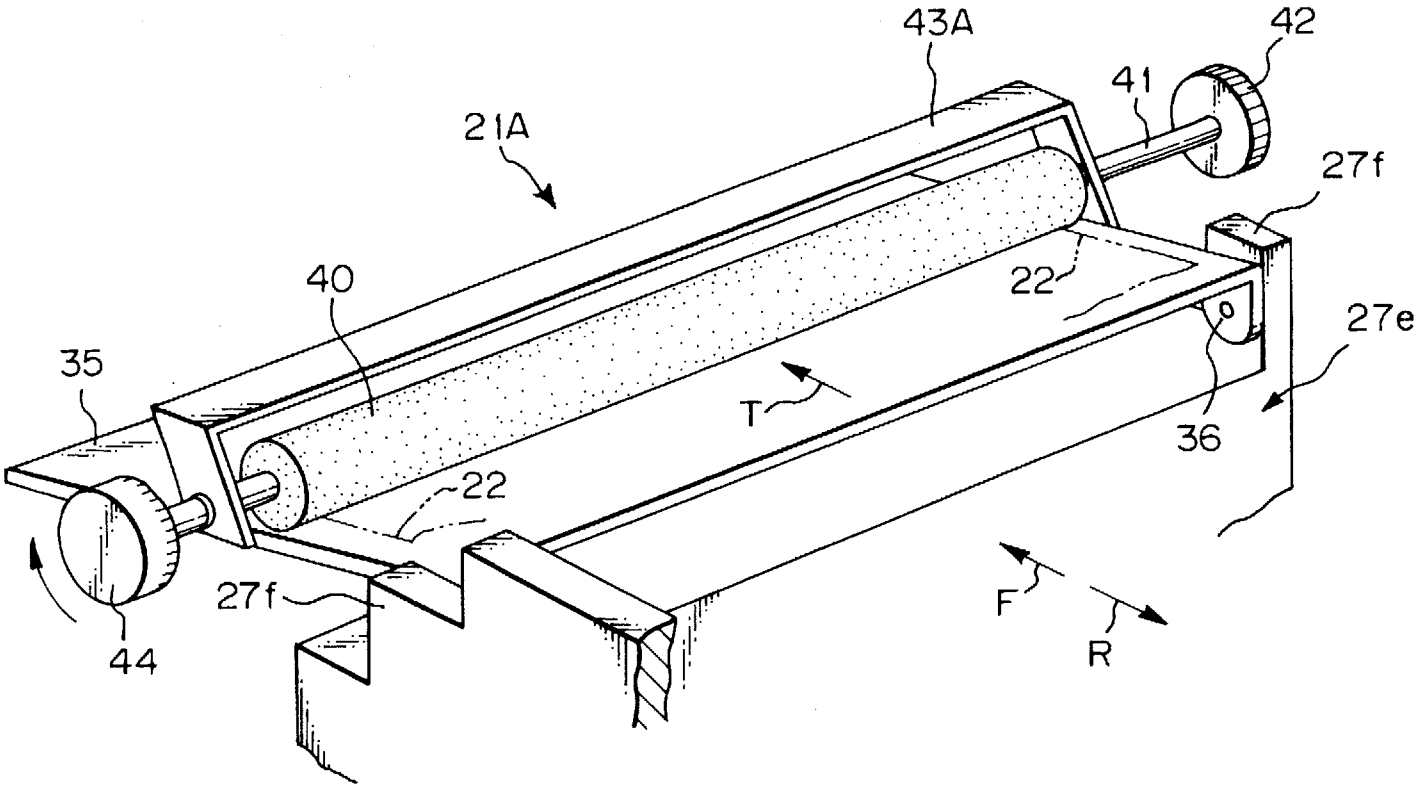
FIG. 24 is a fragmentary perspective view showing a second modification of the first embodiment.

Referring to FIG. 24, a second modification of the first embodiment differs from the embodiment in that it has a stencil holding unit 21A in place of the unit 21. Briefly, the stencil holding unit 21A is characterized in that the pay-out roller 40 is constantly held in contact with the guide plate 35.

The stencil holding unit 21A has a roller arm 43A supporting the opposite ends of the shaft 41 such that the pay-out roller 40 remains in constant with the guide plate 35 at all times. A knob 44 for paying out the stencil 22 is mounted on the left end of the shaft 41, as seen in FIG. 24. The roller arm 43A is implemented by sheet metal and has the lower ends of its leg portions affixed to the opposite side edges of the guide plate 35 in the vicinity of the stubs 36. The pay-out roller 40 extends between the inner surfaces of the legs of the roller arm 43A and remains in contact with the guide plate 35. The knob 44 is formed of synthetic resin and has its circumference knurled for easy manipulation. For example, after the stencil holding unit 21A has been brought to the inoperative position, the operator inserts the leading edge of the stencil 22 into between the pay-out roller 40 and the guide plate 35, and then rotates the knob 44 clockwise. As a result, the pay-out roller 40 is rotated clockwise to pay out the leading edge of the stencil 22 to a position downstream, in the direction T, of the position where the roller 40 contacts the guide plate 35.

The operator removes the used roll 23 from the roll holder 27, sets a new roll 23 on the roll holder 27, and then pulls out the leading edge of the stencil 22 from the new roll 23, as in the first embodiment. Subsequently, the operator inserts the leading edge of the stencil 22 into between the pay-out roller 40 and the guide plate 35, and then pays it out to the above position by operating the knob 44, as stated above. Thereafter, the operator pushes the stencil holding unit 21A in the direction F by holding the knob 27*b*, as in the first embodiment. This not only simplifies the manipulation but also reduces the weight of the writing device due to the simplified configuration of the roller arm 43A.

3rd Modification

Figure 25:
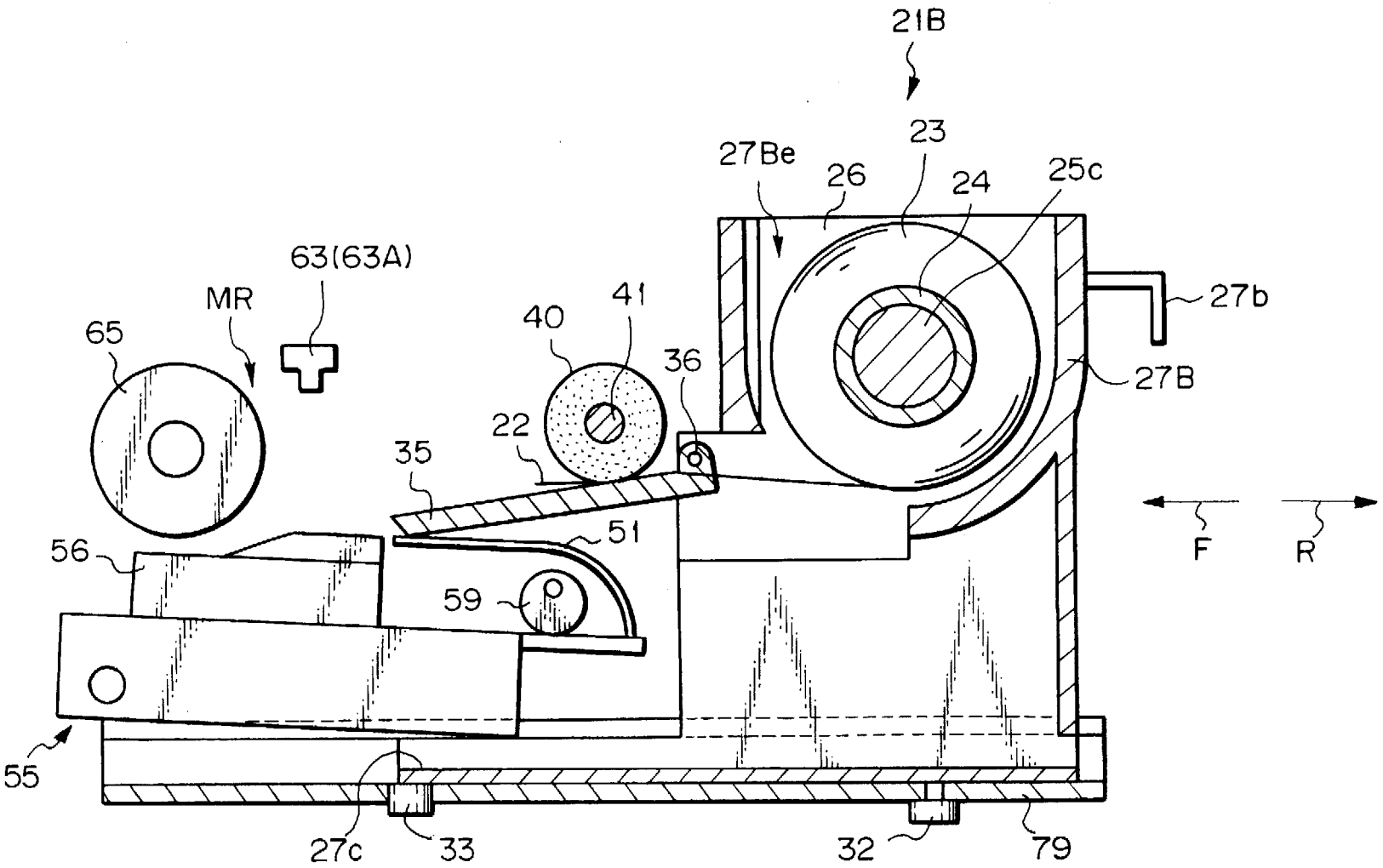
FIG. 25 is a fragmentary front view showing a third modification of the first embodiment.

FIG. 25 shows a third modification including a stencil holding unit 21B in place of the unit 21. Briefly, the stencil holding unit 21B causes the stencil 22 to be paid out from the roll 23 in the clockwise direction.

Specifically, the stencil holding unit 21B has a roll holder 27B extended upward. The roll holder 27B has a stencil outlet at its bottom, so that the stencil 22 can be paid out from the roll 23 in the clockwise direction.

4th Modification

Figure 26:
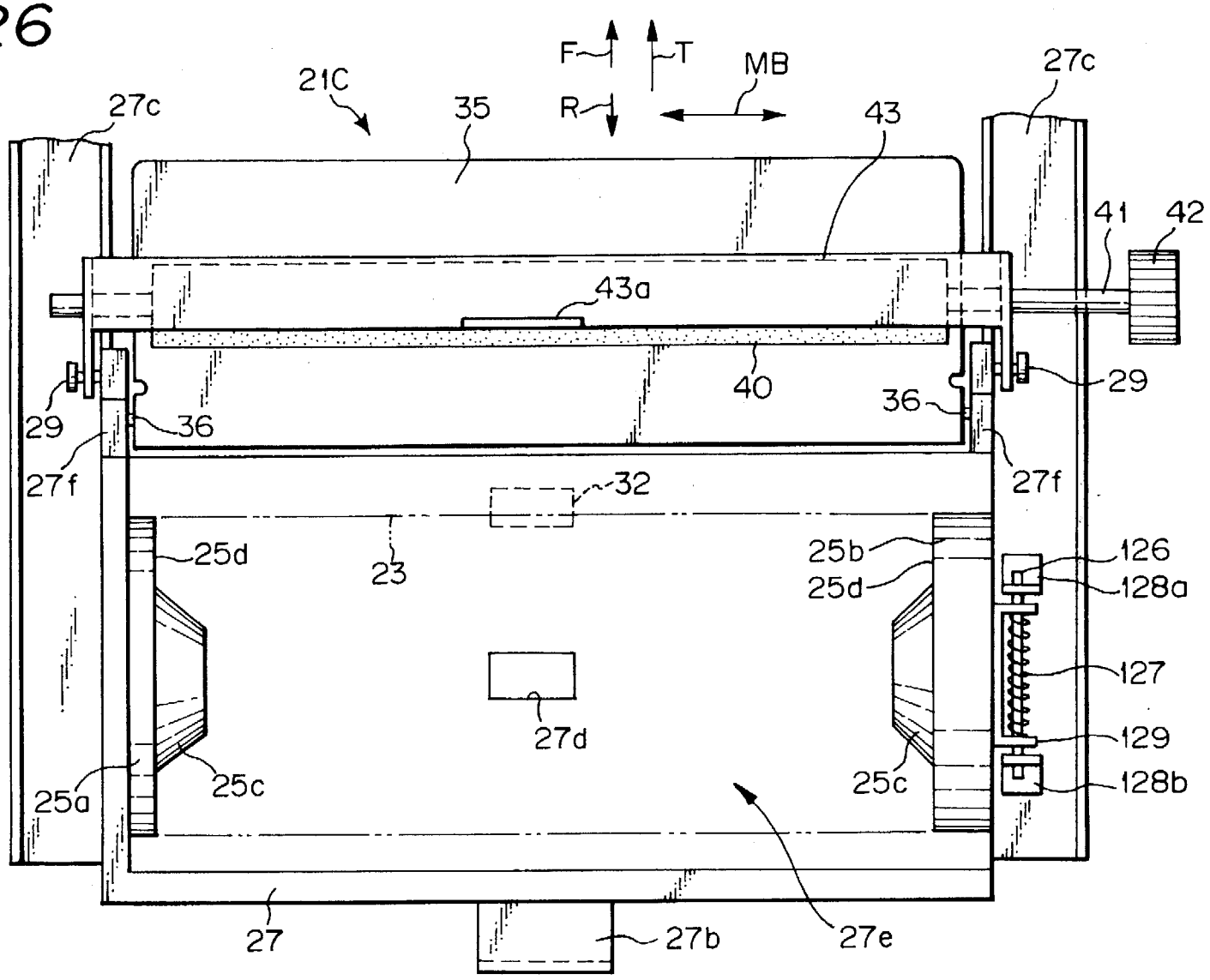
FIG. 26 is a fragmentary plan view showing a fourth modification of the first embodiment.
Figure 27:
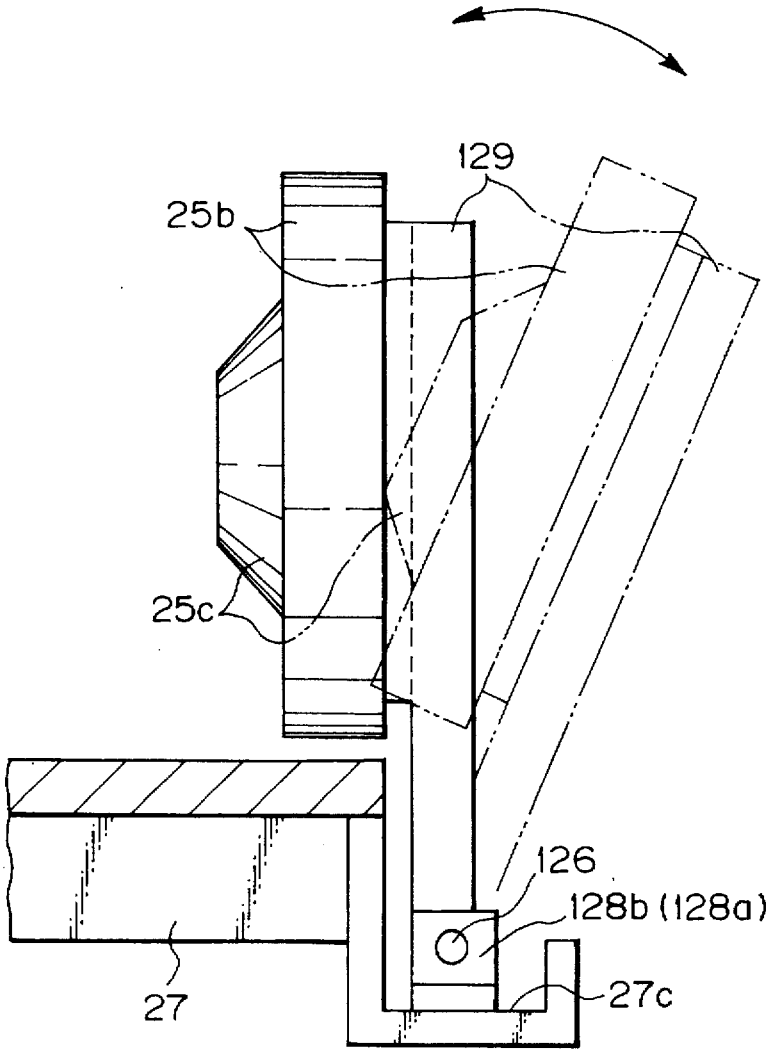
FIG. 27 is a fragmentary side elevation showing a roll flange included in the fourth modification together with members associated therewith.

A reference will be made to FIGS. 26 and 27 for describing a fourth modification of the first embodiment. As shown, the modification has a stencil holding unit 21C in place of the unit 21. The stencil holding unit 21C has the roll flange or roll positioning means 25*b* which is movable between an advanced position (solid line, FIGS. 26 and 27) and a retracted position (dash-and-dots line, FIG. 27). At the advanced position, the roll flange 25*b* contacts one end t of the roll 23 and thereby positions it. At the retracted position, the roll flange 25*b* is spaced from the end t of the roll 23. The roll positioning guiding means 30 is replaced with a torsion spring 127 constantly biasing the roll flange 25*b* toward the advanced position.

A flange mount member 129 has a generally U-shaped configuration, as seen in a plan view, and has its free end portion affixed to the outer surface of the roll flange 25*b*. *The flange mount member 129 is implemented as, e.g., a molding of synthetic resin with sheet metal inserted therein and is rotatable between the advanced position and the retracted position. Specifically, a front and a rear bearing member 128a* and 128*b* are affixed to the inner periphery of the right slide rail 27*c*, as viewed in FIG. 26, and implemented by sheet metal. The base portion of the flange mount member 129 is mounted on a shaft 126 rotatably supported by the bearing members 128*a* and 128*b*. The torsion spring 127 is wound round the shaft 126 and constantly biases the roll flange 25*b* toward the advanced position. The bias of the torsion spring 127, like the sliding force of the roll positioning guiding means 30, is selected such that it positions the roll 23 tridimensionally, and allows the stencil 22 to be paid out from the roll 23 in the direction T while causing the friction portion 25*d* of the roll flange 25*b* to exert an adequate degree of frictional resistance on the end t of the roll 23.

As stated above, this modification does not include the roll positioning guiding means 30, i.e., a mechanism mechanically interlocked to the movement of the stencil holding unit 21. Therefore, the operator intending to load a new roll 23 in the stencil storing means should only move the roll flange 25*b* to its retracted position against the action of the torsion spring 127. Then, after the loading of the new roll 23, the roll flange 25*b* is automatically moved to its advanced position by the torsion spring 127, thereby positioning the roll 23. To remove the used roll 23, the operator should only move the roll flange 25*b* to its retracted position against the action of the torsion spring 127. This kind of scheme allows the operator to load and unload the roll 23 surely and relatively easily with a relatively inexpensive arrangement.

2nd Embodiment

Figure 28:
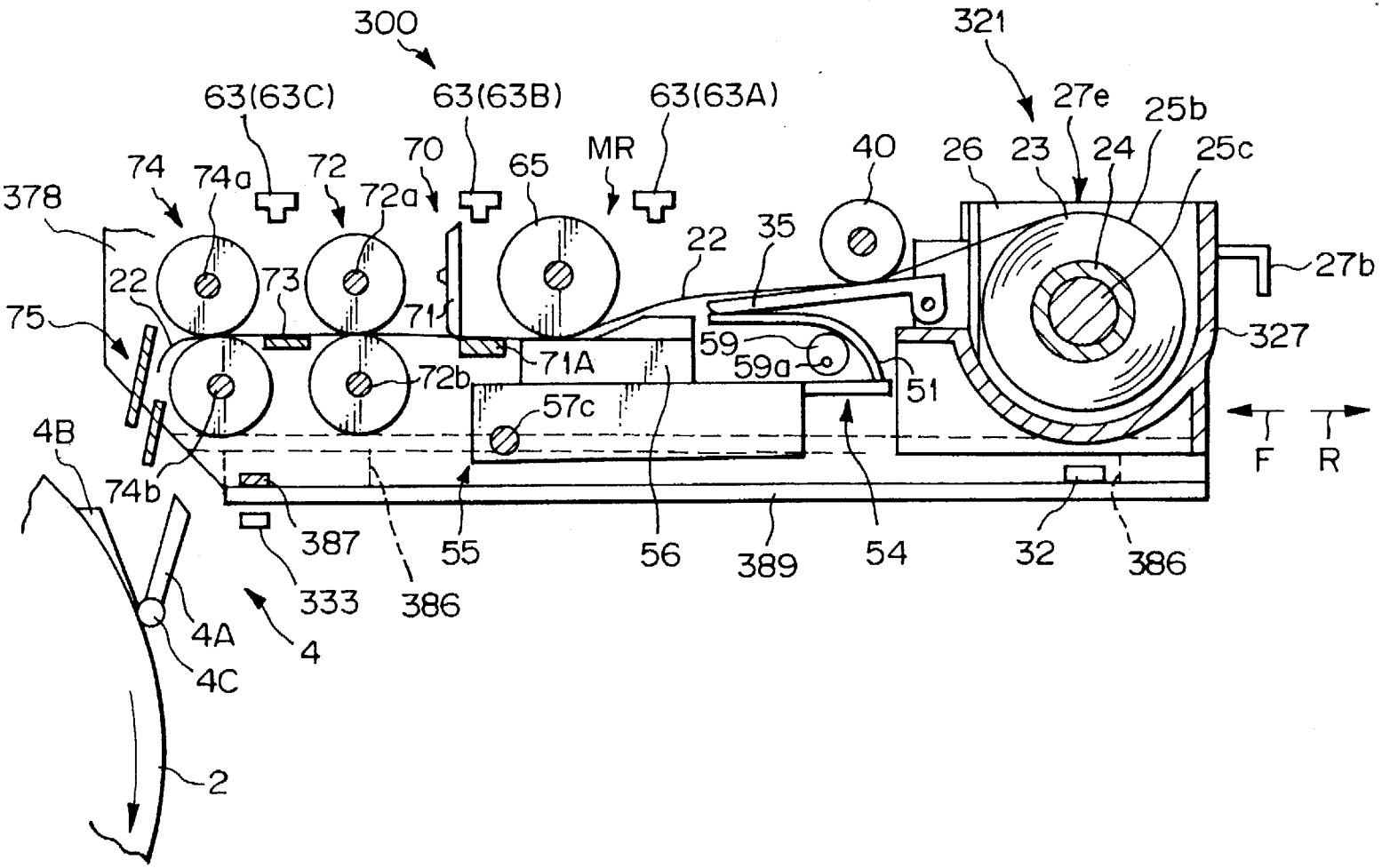
FIG. 28 is a partly sectional front view showing a second embodiment of the present invention.
Figure 29:
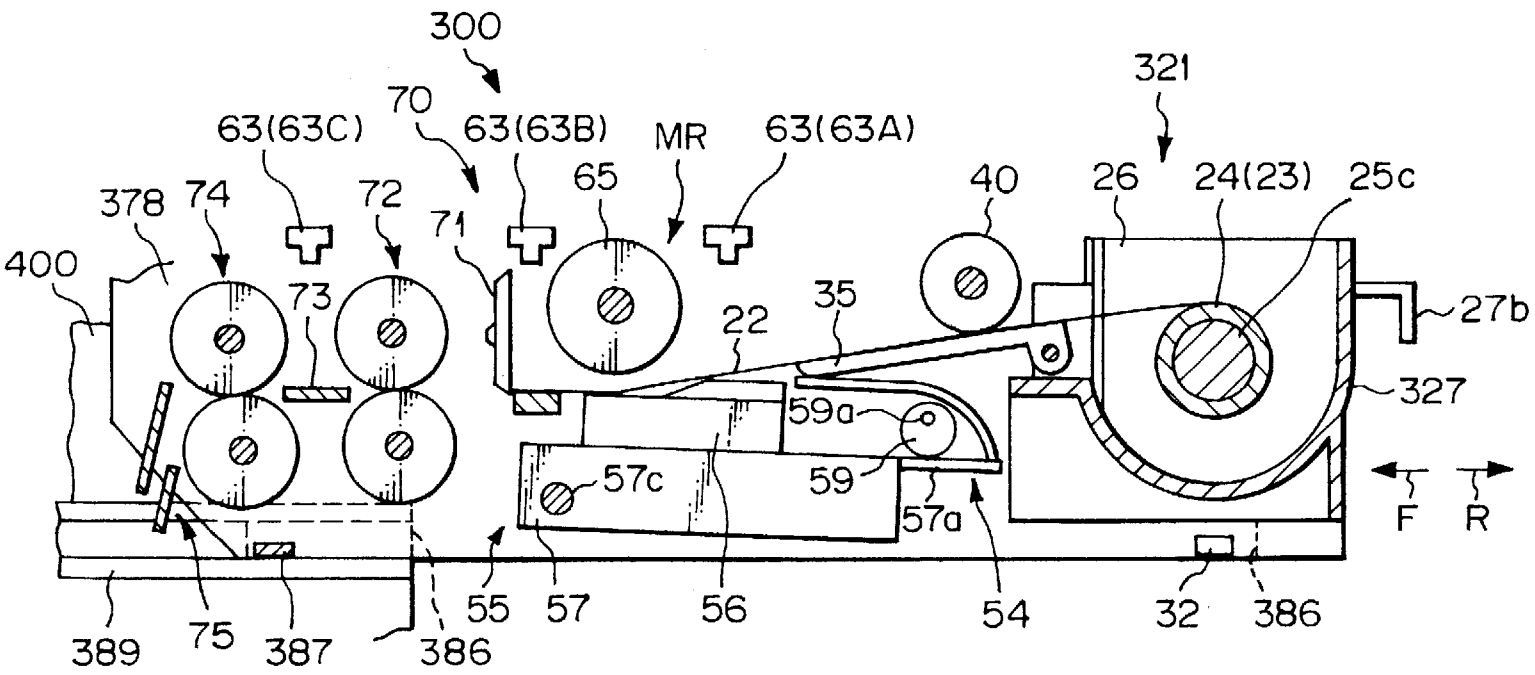
FIG. 29 is a partly sectional enlarged front view showing a master making unit included in the second embodiment and located at its inoperative position.

Referring to FIGS. 28–31, a second embodiment of the image writing device in accordance with the present invention is shown. As shown, a master making unit 300 which is a substitute for the image writing device 20 is removably mounted on the printer body. Specifically, a stencil holding section 321 is unmovable and includes stencil storing means similar to the stencil holding unit 21. The roll 23 can be loaded and unloaded from the stencil holding section 321. The guide plate or stencil guiding means 35 adjoins the stencil holding section 321 and allows the leading edge of the stencil 22 paid out from the roll 23 to be laid thereon. The pay-out roller or stencil conveying means 40 also adjoins the stencil holding section 321 and contacts the guide plate 35 with the intermediary of the stencil 22. The stencil holding section 321, guide plate 35, pay-out roller 40, master making means, cutting means and two conveyor roller pairs 72 and 74 constitute the master making unit 300. The master making unit 300 is movable between an operative position defined in the printer body (FIG. 28) and an inoperative position remote from the operative position (FIG. 29).

More specifically, the master making unit 300 has a right and a left side wall 378 at its opposite sides. The side walls 378 support the left wall of a roll holder 327, the right and left bottom portions of the roll holder 327, the right and left ends of the guide rail 71A, the right and left ends of the first guide 73, the right and left ends of the second guide 75, and the drive mechanism assigned to the cutting means. Further, the side walls 378 support the first to third leading edge sensors 63A, 63B and 63C via stationary members, not shown. In addition, the side walls 378 have bearing portions rotatably supporting the right end of the cam shaft 59*a* included in the platen pressure control means 54, the right and left ends of the shaft 57*c* of the head base 57, the right and left ends of the shaft 65*a* of the platen roller 65, the right and left ends of the shafts 72*a* and 72*b* of the roller pair 72, and the right and left ends of the shafts 74*a* and 74*b* of the roller pair 74.

Figure 30:
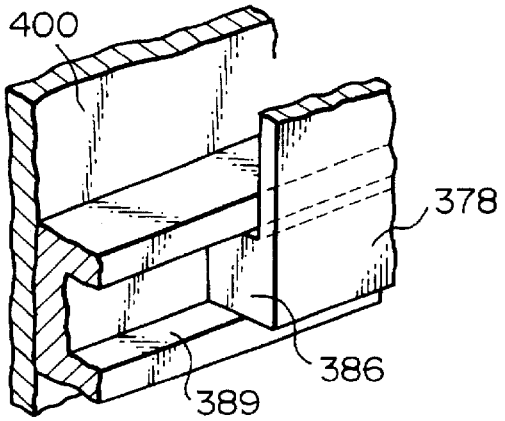
FIG. 30 is a fragmentary perspective view showing a guide rail included in the second embodiment together with its associated member.

The master making unit 300 is movable in the directions F and R shown in FIGS. 28 and 29. As shown in FIG. 30, four projections 386 each having a rectangular cross-section are respectively formed on the front and rear lower portions of the two side walls 378 of the unit 300. As shown in FIGS. 29 and 30, the printer body has a right and left side wall 400 sandwiching the unit side walls 378. Guide rails or guiding means 389 are respectively mounted on the printer side walls 400. The projections 386 of the unit side walls 378 are received in the associated guide rails 389 so as to allow the unit 300 to move between the operative position and the inoperative position. The guide rails 389 are implemented by sheet metal, and each has a channel-like cross-section. The guide rails 389 are positioned such that their open ends face each other.

As indicated by parentheses in FIGS. 4 and 5, the right printer side wall 400 includes an inclined guide portion 478*a* and a slide guide portion 478*b* respectively engageable with the inclined portion 26*a* and slide portion 26*b* of the flange support plate 26.

The stencil holding section 321 has the roll holder 327 lacking the slide rails 27*c*. The roll flange 25*b* is movable between the advanced position and the retracted position in the same manner as in the first embodiment. In the advanced position, the roll flange 25*b* contacts the end t of the roll 23 and positions it. In the retracted position, the roll flange 25*b* is spaced from the end t of the roll 23.

In FIG. 5, roll positioning guiding means 430 guides the movement of the roll flange 25*b* between the advanced position and the retracted position. The guiding means 430 consists of the inclined portion 26*a* and slide portion 26*b* of the flange support plate 26, the inclined guide portion 478*a* and slide guide portion 478*b* of the right printer side wall 400, and the slide piece 26*c*, slot 26*d*, guide plate 27*a*, compression spring 28, and stepped pins 29A.

Figure 31:
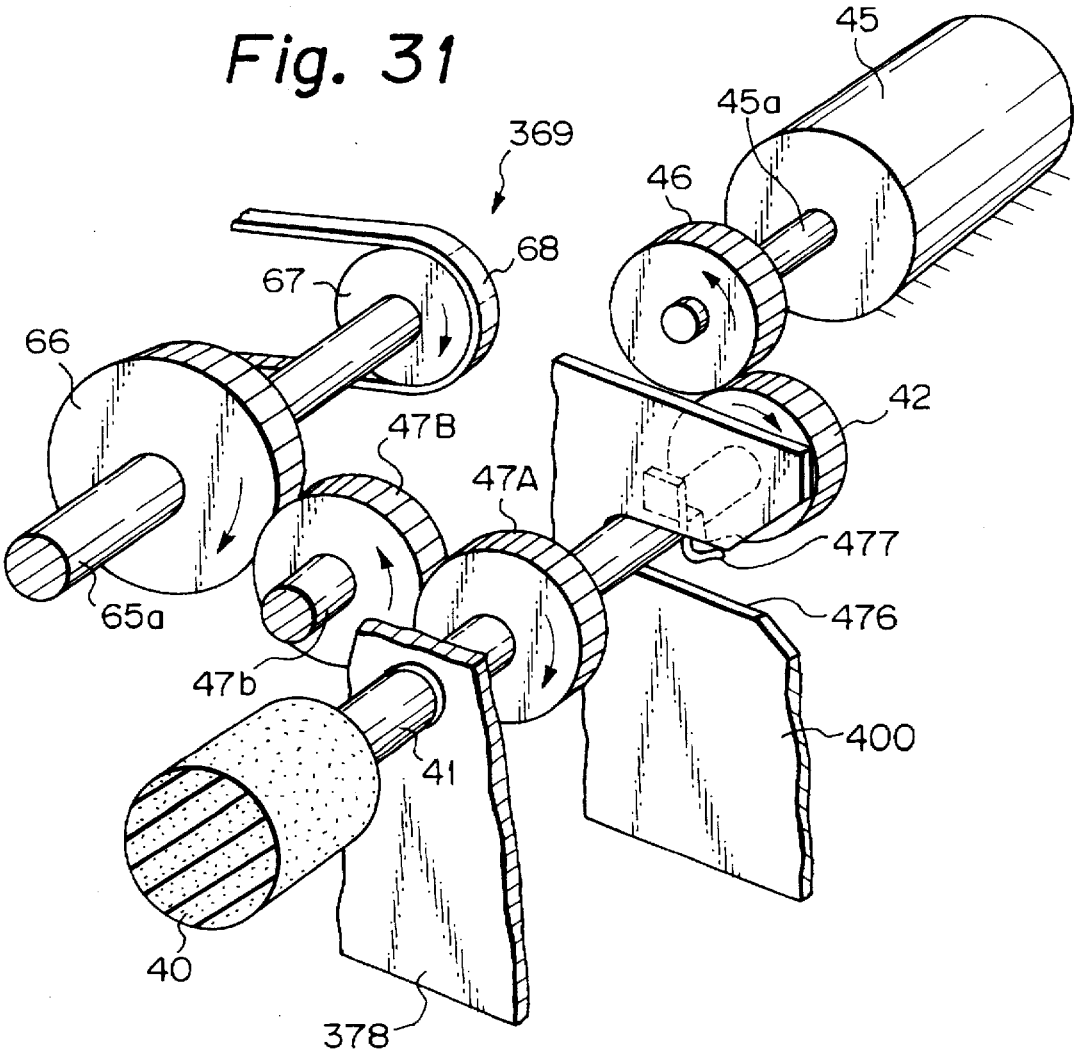
FIG. 31 is a fragmentary perspective view showing the master making unit of the second embodiment located at its operative position, together with a drive transmission mechanism.

As shown in FIG. 31, a drive transmission mechanism 369 transmits the rotation of the motor 45 to the platen roller 65, not shown. The mechanism 369 differs from the mechanism 69 of the first embodiment in that the smaller diameter drive gear 46A is omitted, and in that the first idler gear 47A is mounted on the shaft 41 between the right printer side wall 400 and the right unit side wall 378. The second idler gear shaft 47*b* and platen roller shaft 65*a* are rotatably supported by the right unit side wall 378.

The motor 45 is mounted on a stationary member, not shown, affixed to the right printer side wall 400. The opposite printer side walls 400 are each provided with a notch 476 and a leaf spring 477, as in the first embodiment. When the master making unit 300 is brought to the operative position, the output torque of the motor 45 is transferred to the pay-out roller 40. When the unit 300 is moved to the inoperative position, the torque transmission to the pay-out roller 40 is interrupted. In this sense, the motor 45 additionally plays the role of means for rotating the platen roller 65.

In the illustrative embodiment, the motor 58 assigned to the head base 57 is mounted on a stationary member, not shown, provided on the right unit side wall 378. The motor gear 60 is mounted on the output shaft of the motor 58 and constantly held in mesh with the cam gear 61, as in the first embodiment. A reflection surface 387 (indicated by hatching) is provided on the front bottom of the right unit side wall 378. A stencil set sensor 333 is mounted on the front lower portion of the guide rail 389 of the right printer side wall 400. The sensor 333 is implemented as a reflection type photosensor for sensing the reflection surface 387.

The illustrative embodiment is also practicable with the control arrangement shown in FIG. 9 only if the stencil set sensor 333 is connected to the input port of the controller 100 in place of the stencil set sensor 33. In addition, procedures shown in FIGS. 20 and 21 are applicable to this embodiment except that in the step ST2 the stencil set sensor 33 is replaced with the stencil set sensor 333. Specifically, when the master making unit 300 is brought to the operative position, the stencil set sensor 333 senses the reflection surface 387 and sends its output to the controller 100. In response, the controller 100 executes the step ST3 and successive steps shown in FIG. 20. When the master making unit 300 is moved away from the operative position, the controller 100 drives the platen pressure control means 54 in order to cancel the pressure acting on the stencil 22.

As stated above, the master making unit 300 is bodily movable between the operative position and the inoperative position. When the document reading section disposed in the upper portion of the printer is not slidable, the unit 300 can be moved away from the operative position in order to deal with the stencil 22 jamming the transport path at, e.g., the platen roller 65, cutting section 70, or roller pair 72 or 74.

In the illustrative embodiment, the master making unit 300 consists of the stencil holding section 321, guide plate 35, pay-out roller 40, master making means, cutting means, and two roller pairs 72 and 74. If desired, cutting means and the two roller pairs 72 and 74 may be omitted from the unit 300, in which case the cutting means and roller pairs 72 and 74 will be mounted on the printer body.

Of course, the master making unit 300 may be replaced with a suitable combination of the first embodiment and its first to fourth modifications. Any one of the first to fourth modifications of the first embodiment may, of course, be applied to the second embodiment.

Any one of the first embodiment and its modifications and the second embodiments may be changed or modified, as follows. The elongate pay-out roller 40 may be replaced with a plurality of roller elements mounted on a single shaft and spaced from each other in the axial direction of the shaft. This kind of roller configuration successfully reduces the cost.

The operation sensing means is implemented by the stencil sensor 32 and stencil set sensor 33 or 333. Alternatively, the roll holder 27, 270, 27B or 327 of the stencil holding unit 21, 210, 21A, 21B or 21C or stencil holding section 321 may be implemented as an openable lid including the knob **27*b***. In such a case, a sensor responsive to the closure of the lid will be provided to play the role of the operation sensing means.

The stencil set sensor 33 or 333 is used as the operation sensing means for causing the pay-out roller 40 to start operating via the motor 45. Alternatively, in the first embodiment, the stencil sensor 32 may be used for the above purpose. This is because the stencil sensor 32 determines not only whether or not the roll 23 is present, but also whether or not the roll 23 loaded in the cavity **27*e* or 27B*e* is set at the preselected position in the image writing device 20 or 200**.

The above operation sensing means may be replaced with the previously mentioned operation set key or operation setting means **64*a* indicated by a phantom line in FIG. 9. The operator may press the operation set key 64*a* after moving the stencil holding unit 21, 210, 21A, 21B or 21C or the master making unit 300 to the operative position. Then, the controller 100 will cause the motor 45 to start driving the pay-out roller 40. Specifically, on receiving the output of the key 64*a*, the controller 100 will cause the motor 45 to continuously drive the pay-out roller 40 until the leading edge sensor 63 (63A, 63B or 63C) senses the leading edge of the stencil 22. In response to the output of such a sensor, the controller 100 will cause the thermal head 56 and platen roller 65 to nip the stencil 22**.

To smooth the stencil 22, the platen pressure control section 55 causes the head 56 and platen roller 65 to contact each other intermittently in response to the output of the second leading edge sensor 63B. However, the smoothing operation is not essential if the leading edge of the stencil 22 is conveyed in the direction parallel to the axial direction of the platen roller 65 and is free from creases. On the other hand, an arrangement may be made such that the head 56 and platen roller 65 are held in contact each other until the third leading edge sensor 63C senses the leading edge of the stencil 22, and the motor 58 is driven in response to the output of the sensor 63C in order to cause the head 56 and roller 65 to contact intermittently, thereby smoothing the stencil 22. To smooth the stencil 22, it is only necessary for the head 56 and platen roller 65 to be released from each other at least once.

The head 56 and platen roller 65 are caused to contact each other when the leading edge of the stencil 22 arrives at the position where they are located. Therefore, the leading edge of the stencil 22 is free from obstruction until it reaches the above position, and then surely pressed at such a position.

The stencil holding unit 21, 210, 21A, 21B or 21C has been shown and described as being moved between the operative position and the inoperative position by hand. Alternatively, if the simple configuration and low cost are not an important issue, exclusive keys for effecting the above movement may be provided on the operation panel 64, and the stencil holding unit may be electrically driven by, e.g., a motor.

While the platen roller 65 has been shown and described as being driven by the drive transmission mechanism 69 or 369, it may be implemented as a driven roller. Specifically, an arrangement may be made such that a conveyor roller pair located downstream of the platen roller 65 in the direction T pulls out the stencil 22 from the roll 23 through the rotation of the pay-out roller 40, and the platen roller 65 is caused to contact the head 56 and driven by the stencil 22.

The master making means including the head 56 and platen roller 65 may be replaced with any other suitable master making means, e.g., flash type or laser type master making means.

The stencil 22 in the form of the roll 23 may be replaced with a stencil as thin as about 1 μm to 3 μm and consisting substantially only of a thermoplastic resin film. It is to be noted that the stencil consisting substantially only of a thermoplastic resin film includes even a thermoplastic resin film containing a trace of, e.g., an antistatic agent or a thermoplastic resin film carrying one or more overcoat layers on at least one of opposite major surfaces thereof.

The present invention is practicable not only with the stencil printer 1 shown and described, but also with a printer of the type feeding ink from the outside of a print drum, as taught in, e.g., Japanese Patent Laid-Open Publication No. 7-17013.

In summary, it will be seen that the present invention provides an image writing device for a stencil printer and having various unprecedented advantages, as enumerated below.

(1) The device makes it needless for the operator to move a document reading section or to insert the leading edge of a stencil into between a thermal head and a platen roller included in an image writing section. This simplifies the roll replacing operation and allows the operator to understands it easily. In addition, the leading edge of the stencil can be surely pulled out form the roll by hand. The device is therefore highly reliable, simple, and low cost. In addition, because the document reading section does not have to be moved by the operator, the device does not increase the machining cost or the assembling cost of structural parts for enhancing the mechanical strength of the image reading section.

(2) It is not necessary for the operator to attach and detach roller flanges from the opposite ends of the tubular core of the roll. This further simplifies the roll replacement and makes it more easy to understand.

(3) The roll can be replaced surely and easily despite the relatively inexpensive construction.

(4) The stencil being paid out from the roll is free from slackening.

(5) A stencil holding unit included in the device is simple, light weight, and inexpensive.

(6) The stencil can be accurately conveyed to the downstream side in a stencil feed direction while being surely cut by a thermal head and a platen roller rotatable in contact with the head with the intermediary of the stencil.

(7) The head and platen roller can surely nip and press the stencil therebetween.

(8) A master making unit is movable between the operative position and the inoperative position. Therefore, in a printer of the type having an unmovable document reading section, the stencil jamming a stencil transport path can be surely and easily dealt with only if the master making unit is moved away from the operative position.

(9) The operator does not have to insert the leading edge of the stencil into between the head and the platen roller or to cut off the leading edge of the stencil and remove it. This further enhances the easy operation of the printer.

(10) The stencil holding unit can be pulled out to its inoperative position without any resistance acting thereon because the stencil is free from tension.

(11) Tension is repeatedly acts on the stencil being paid out from the roll. As a result, the stencil is free from slackening which would result in defective stencil feed.

(12) It is easy to select a coefficient of friction necessary for conveying the stencil via stencil conveying means. Moreover, the influence of the load on the stencil conveying means is negligible, so that margins in the design aspect are increased.

(13) The device is operable with a minimum number of drive means and further simplified in construction and reduced in cost.

(14) Tension acts on the portion of the stencil nipped between the stencil conveying means and stencil guiding means and being conveyed by the stencil conveying means, the portion of the same nipped between the head and the platen roller and being conveyed by the platen roller. This prevents the stencil from jamming the path due to, e.g., slackening.

(15) The head and platen roller contact each other highly accurately because their contact is free from the influence of the movement of a rotating member abutting against a support member.

(16) The device is miniature, reduces the size of the roll, enhances image quality by reducing fiber marks, and implements high-speed master making by reducing the stencil cutting time.

Various modifications will become possible for those skilled in the art after receiving the teachings of the present disclosure without departing from the scope thereof.

What is claimed is:

1. A device for writing an image in a stencil, comprising:

a body;

stencil storing means for storing the stencil in a form of a roll such that the stencil can be paid out from the roll;

master making means for perforating the stencil paid out from the roll to thereby make a master;

cutting means for cutting off the master from the stencil;

a stencil holding unit movable between an operative position defined in said body, and an inoperative position remote from said operative position and allowing the roll to be loaded and unloaded from said stencil storing means;

guiding means for guiding said stencil holding unit between said operative position and said inoperative position;

stencil guiding means included in said stencil holding unit, and for laying a leading edge of the stencil paid out from the roll thereon;

stencil conveying means included in said stencil holding unit, and for conveying the stencil in contact with said stencil guiding means via the leading edge of the stencil; and stencil drive means for driving said stencil conveying means.

2. A device as claimed in claim 1, further comprising:

roll positioning means disposed in said stencil storing means and selectively movable, when said stencil holding unit is brought to said operative position, to an advanced position for contacting one axial end of the roll to thereby position the one end or movable, when said stencil holding unit is brought to said inoperative position, to a retracted position spaced from the one end; and roll positioning guiding means for guiding said roll positioning means between said advanced position and said retracted position.

3. A device as claimed in claim 2, wherein said roll positioning means comprises a substantially frustoconical roll flange for positioning the roll by entering a tubular core round which the stencil is wound in the form of the roll.

4. A device as claimed in claim 1, further comprising:

roll positioning means selectively movable, when said stencil holding unit is brought to said operative position, to an advanced position for contacting one axial end of the roll to thereby position the one end or movable, when said stencil holding unit is brought to said inoperative position, to a retracted position spaced from the one end; and biasing means for resiliently biasing said roll positioning means toward said advanced position.

5. A device as claimed in claim 4, wherein said roll positioning means comprises a substantially frustoconical roll flange for positioning the roll by entering a tubular core round which the stencil is wound in the form of the roll.

6. A device as claimed in claim 1, wherein said stencil conveying means is movable into and away from said stencil guiding means when said stencil holding unit is located at said inoperative position.

7. A device as claimed in claim 1, wherein said stencil conveying means is held in contact with said stencil guiding means when said stencil holding unit is located at said operative position, or is spaced from said stencil guiding means when said stencil holding unit is located at said inoperative position.

8. A device as claimed in claim 1, wherein said stencil drive means is provided on said body, and wherein a driving force output from said stencil drive means is transferred to said stencil conveying means when said stencil holding unit is located at said operative position, or not transferred to said stencil conveying means when said stencil holding unit is located at said inoperative position.

9. A device as claimed in claim 1, wherein said master making means comprises:

a thermal head for selectively perforating the stencil with heat; and a platen roller rotatable while pressing the stencil between said platen roller and said thermal head.

10. A device as claimed in claim 9, wherein said thermal head and said platen roller are movable into and out of contact with each other, and wherein said stencil guiding means adjoins or contacts one of said thermal head and said platen roller when said stencil holding unit is located at said operative position.

11. A device as claimed in claim 9, further comprising introducing means provided between a position close to a pressing position where said thermal head and said platen roller press the stencil and said stencil guiding means, and for positioning the leading edge of the stencil being conveyed by said stencil conveying means at said position close to said pressing position.

12. A device as claimed in claim 9, wherein said thermal head and said platen roller are movable into and out of contact with each other, and wherein said device further comprises:

platen pressure control means for causing said thermal head and said platen roller to selectively contact each other;

operation sensing means for determining a time for causing said stencil conveying means to start operating;

leading edge sensing means positioned on a stencil transport path to which the leading edge of the stencil is paid out, and for sensing the leading edge of the stencil; and control means for causing, in response to an output signal of said operation sensing means, said stencil conveying means to continuously pay out the stencil via said stencil drive means until said leading edge sensing means senses the leading edge of the stencil, and then causes, in response to an output signal of said leading edge sensing means indicative of the leading edge, said platen pressure control means to set up a condition in which said thermal head and said platen roller can press the stencil therebetween.

13. A device as claimed in claim 12, wherein said operation sensing means comprises stencil set sensing means responsive to said stencil holding unit brought to said operative position, and wherein said control means causes, when said stencil holding unit is moved away from said operative position as sensed by said stencil set sensing means, said platen pressure control means to set up a condition wherein a pressure acting on the stencil between said thermal head and said platen roller is cancelled.

14. A device as claimed in claim 12, wherein said control means controls, in response to the output signal of said leading edge sensing means, said platen pressure control means to cause said thermal head and said platen roller to press the stencil intermittently.

15. A device as claimed in claim 9, further comprising:

platen pressure control means for causing said thermal head and said platen roller to selectively contact each other;

operation setting means for determining a time for causing said stencil conveying means to start operating;

leading edge sensing means positioned on a stencil transport path to which the leading edge of the stencil is paid out, and for sensing the leading edge of the stencil; and control means for causing, in response to an output signal of said operation setting means, said stencil conveying means to continuously pay out the stencil via said stencil drive means until said leading edge sensing means senses the leading edge of the stencil, and then causes, in response to an output signal of said leading edge sensing means indicative of the leading edge, said platen pressure control means to set up a condition in which said thermal head and said platen roller can press the stencil therebetween.

16. A device as claimed in claim 15, wherein said control means controls, in response to the output signal of said leading edge sensing means, said platen pressure control means to cause said thermal head and said platen roller to press the stencil intermittently.

17. A device as claimed in claim 1, wherein said stencil conveying means comprises a sponge-like roller.

18. A device as claimed in claim 1, wherein said master making means comprises a thermal head for selectively perforating the stencil with heat, and a platen roller rotatable while pressing the stencil between said platen roller and said thermal head, and wherein said stencil drive means additionally plays the role of platen roller drive means for causing said platen roller to rotate.

19. A device as claimed in claim 1, wherein said master making means comprises a thermal head for selectively perforating the stencil with heat, and a platen roller rotatable while pressing the stencil between said platen roller and said thermal head, and wherein a conveying force of said platen roller acting on the stencil is greater than a conveying force of said stencil conveying means acting on the stencil.

20. A device as claimed in claim 1, wherein said master making means comprises a thermal head for selectively perforating the stencil with heat, and a platen roller rotatable while pressing the stencil between said platen roller and said thermal head, a support member rotatably supporting one of said thermal head and said platen roller, and an angularly movable member for selectively contacting said support member to thereby cause one of said thermal head and said platen roller to angularly move, and wherein said angularly movable member is spaced from said support member when said thermal head and said platen roller contact each other with the intermediary of the stencil.

21. A device for writing an image in a stencil for a stencil printer, comprising:

stencil storing means for storing the stencil in a form of a roll such that the stencil can be paid out from the roll;

master making means for perforating the stencil paid out from the roll to thereby produce a master;

cutting means for cutting off the master from the stencil;

a stencil holding section capable of being loaded with the roll;

stencil guiding means adjoining said stencil holding section, and for laying a leading edge of the stencil paid out from the roll thereon;

stencil conveying means adjoining said stencil holding section, and for conveying the stencil in contact with said stencil guiding means via the leading edge of the stencil; and stencil drive means for driving said stencil conveying means;

wherein said master making means, said stencil holding section, said stencil guiding means and said stencil conveying means constitute a master making unit movable between an operative position defined within a body of the printer and an inoperative position remote from said operative position and allowing the roll to be loaded and unloaded.

22. A device as claimed in claim 21, further comprising roll positioning means disposed in said stencil storing means and selectively movable, when said master making unit is brought to said operative position, to an advanced position for contacting one axial end of the roll to thereby position the one end or movable, when said master making unit is brought to said inoperative position, to a retracted position spaced from the one end; and roll positioning guiding means for guiding said roll positioning means between said advanced position and said retracted position.

23. A device as claimed in claim 22, wherein said roll positioning means comprises a substantially frustoconical roll flange for positioning the roll by entering a tubular core round which the stencil is wound in the form of the roll.

24. A device as claimed in claim 21, further comprising:

roll positioning means movable between an advanced position for contacting one axial end of the roll to thereby position the one end and a retracted position spaced from the one end; and biasing means for resiliently biasing said roll positioning means toward said advanced position.

25. A device as claimed in claim 24, wherein said roll positioning means comprises a substantially frustoconical roll flange for positioning the roll by entering a tubular core round which the stencil is wound in the form of the roll.

26. A device as claimed in claim 21, wherein said stencil drive means is provided on said body of the printer, and wherein a driving force output from said stencil drive means is transferred to said stencil conveying means when said master making unit is located at said operative position, or not transferred to said stencil conveying means when said master making unit is located at said inoperative position.

27. A device as claimed in claim 21, wherein said master making means comprises:

a thermal head for selectively perforating the stencil with heat; and a platen roller rotatable while pressing the stencil between said platen roller and said thermal head.

28. A device as claimed in claim 27, wherein said thermal head and said platen roller are movable into and out of contact with each other, and wherein said device further comprises:

platen pressure control means for causing said thermal head and said platen roller to selectively contact each other;

operation sensing means for determining a time for causing said stencil conveying means to start operating;

leading edge sensing means positioned on a stencil transport path to which the leading edge of the stencil is paid out, and for sensing the leading edge of the stencil; and control means for causing, in response to an output signal of said operation sensing means, said stencil conveying means to continuously pay out the stencil via said stencil drive means until said leading edge sensing means senses the leading edge of the stencil, and then causes, in response to an output signal of said leading edge sensing means indicative of the leading edge, said platen pressure control means to set up a condition in which said thermal head and said platen roller can press the stencil therebetween.

29. A device as claimed in claim 28, wherein said operation sensing means comprises stencil set sensing means responsive to said master making unit brought to said operative position, and wherein said control means causes, when said master making unit is moved away from said operative position as sensed by said stencil set sensing means, said platen pressure control means to set up a condition wherein a pressure acting on the stencil between said thermal head and said platen roller is cancelled.

30. A device as claimed in claim 28, wherein said control means controls, in response to the output signal of said leading edge sensing means, said platen pressure control means to cause said thermal head and said platen roller to press the stencil intermittently.

31. A device as claimed in claim 27, further comprising:

platen pressure control means for causing said thermal head and said platen roller to selectively contact each other;

operation setting means for determining a time for causing said stencil conveying means to start operating;

leading edge sensing means positioned on a stencil transport path to which the leading edge of the stencil is paid out, and for sensing the leading edge of the stencil; and control means for causing, in response to an output signal of said operation setting means, said stencil conveying means to continuously pay out the stencil via said stencil drive means until said leading edge sensing means senses the leading edge of the stencil, and then causes, in response to an output signal of said leading edge sensing means indicative of the leading edge, said platen pressure control means to set up a condition in which said thermal head and said platen roller can press the stencil therebetween.

32. A device as claimed in claim 31, wherein said control means controls, in response to the output signal of said leading edge sensing means, said platen pressure control means to cause said thermal head and said platen roller to press the stencil intermittently.

33. A device as claimed in claim 21, wherein said stencil conveying means comprises a sponge-like roller.

34. A device as claimed in claim 21, wherein said master making means comprises a thermal head for selectively perforating the stencil with heat, and a platen roller rotatable while pressing the stencil between said platen roller and said thermal head, and wherein said stencil drive means additionally plays the role of platen roller drive means for causing said platen roller to rotate.

35. A device as claimed in claim 21, wherein said master making means comprises a thermal head for selectively perforating the stencil with heat, and a platen roller rotatable while pressing the stencil between said platen roller and said thermal head, and wherein a conveying force of said platen roller acting on the stencil is greater than a conveying force of said stencil conveying means acting on the stencil.

36. A device as claimed in claim 21, wherein said master making means comprises a thermal head for selectively perforating the stencil with heat, and a platen roller rotatable while pressing the stencil between said platen roller and said thermal head, a support member rotatably supporting one of said thermal head and said platen roller, and an angularly movable member for selectively contacting said support member to thereby cause one of said thermal head and said platen roller to angularly move, and wherein said angularly movable member is spaced from said support member when said thermal head and said platen roller contact each other with the intermediary of the stencil.

* * * * *